US009606466B2

(12) United States Patent
Takahashi et al.

(10) Patent No.: US 9,606,466 B2
(45) Date of Patent: Mar. 28, 2017

(54) TONER AND TWO-COMPONENT DEVELOPER

(71) Applicant: CANON KABUSHIKI KAISHA, Tokyo (JP)

(72) Inventors: Toru Takahashi, Toride (JP); Yoshihiro Ogawa, Toride (JP); Daisuke Tsujimoto, Matsudo (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/659,505

(22) Filed: Mar. 16, 2015

(65) Prior Publication Data

US 2015/0268577 A1 Sep. 24, 2015

(30) Foreign Application Priority Data

Mar. 20, 2014 (JP) ..... 2014-058172
Mar. 11, 2015 (JP) ..... 2015-048301

(51) Int. Cl.

| | |
|---|---|
| ***G03G 9/00*** | (2006.01) |
| ***G03G 9/135*** | (2006.01) |
| ***G03G 9/097*** | (2006.01) |
| ***G03G 9/087*** | (2006.01) |
| ***G03G 9/09*** | (2006.01) |

(52) U.S. Cl.

CPC ..... *G03G 9/09758* (2013.01); *G03G 9/08733* (2013.01); *G03G 9/08755* (2013.01); *G03G 9/091* (2013.01); *G03G 9/09775* (2013.01); *G03G 9/09783* (2013.01)

(58) Field of Classification Search

CPC ..... G03G 9/09758; G03G 9/08733; G03G 9/09775; G03G 9/08755; G03G 9/09783; G03G 9/091

USPC ..... 430/108.23

See application file for complete search history.

(56) References Cited

U.S. PATENT DOCUMENTS

| | | | | |
|---|---|---|---|---|
| 5,512,402 | A | 4/1996 | Okado et al. | |
| 6,077,635 | A | 6/2000 | Okado et al. | |
| 6,153,347 | A * | 11/2000 | Kabai | G03G 9/08782 430/108.1 |
| 7,094,512 | B2 | 8/2006 | Otsuka et al. | |
| 7,544,457 | B2 | 6/2009 | Hashimoto et al. | |
| 7,816,063 | B2 | 10/2010 | Hashimoto et al. | |
| 2004/0191660 | A1 * | 9/2004 | Otsuka | C07D 231/48 430/108.23 |
| 2013/0252167 | A1 | 9/2013 | Moribe et al. | |
| 2013/0302730 | A1 | 11/2013 | Takahashi et al. | |
| 2014/0004460 | A1 | 1/2014 | Yoshiba et al. | |
| 2015/0241807 | A1 | 8/2015 | Sugahara et al. | |

FOREIGN PATENT DOCUMENTS

| | | | |
|---|---|---|---|
| EP | 0 606 873 | A1 | 7/1994 |
| JP | 3986488 | B2 | 10/2007 |
| JP | 2012-215857 | A | 11/2012 |
| JP | 5132913 | B2 | 1/2013 |
| WO | 2012/133471 | A1 | 10/2012 |

OTHER PUBLICATIONS

European Search Report dated Aug. 20, 2015 in European Application No. 15159801.8.

* cited by examiner

*Primary Examiner* — Thorl Chea
(74) *Attorney, Agent, or Firm* — Fitzpatrick, Cella, Harper & Scinto

(57) ABSTRACT

The present invention is a toner including a toner particle containing a binder resin and a charge control agent, wherein the binder resin includes a resin having a polyester unit with at least one aliphatic compound condensed to the terminal thereof, the at least one aliphatic compound being selected from the group consisting of aliphatic monocarboxylic acids each having 30 or more and 102 or less carbon atoms and aliphatic monoalcohols each having 30 or more and 102 or less carbon atoms; and the charge control agent includes a specific compound (a pyrazolone monoazo metal compound).

8 Claims, No Drawings

TONER AND TWO-COMPONENT DEVELOPER

BACKGROUND OF THE INVENTION

Field of the Invention

The present invention relates to a toner and a two-component developer for developing (visualizing) electrostatic latent images (electrostatic charge images).

Description of the Related Art

Recently, electrophotographic image forming apparatuses (electrophotography apparatuses) such as copying machines and printers have been required to have developability and durable stability capable of stably output images having high image quality, and have been simultaneously required to cope with energy saving.

For the purpose of achieving high image quality and high developability, the properties required for the toner include high charge amount and sharp distribution of charge amount.

As a method for controlling the charge amount of the toner, a method controlling by using a charge control agent is known. Japanese Patent No. 3986488 describes as a charge control agent, a monoazo iron complex compound satisfactory in rise of electric charge.

The charge amount of a toner is significantly affected by the performance of the binder resin in the toner particle. Japanese Patent Application Laid-Open No. 2012-215857 describes the use of, as the binder resin for a toner particle, a polyester resin using an aliphatic polyhydric alcohol having a high hygroscopic property in a proportion of 70 mol % or more, and the use of, as the charge control agent, a pyrazolone monoazo metal compound having a low hygroscopic property. According to the description of the foregoing patent document, in this way, a toner can be obtained in which the charge amount is hardly decreased even in a high-humidity environment.

The use of these charge control agents allows toners relatively high in charge amount to be obtained.

For the purpose of achieving energy saving in image forming apparatuses such as copying machines and printers, the decrease of the fixing temperature of the toner is also effective. Accordingly, for the purpose of improving the low-temperature fixability of the toner, the improvement of the binder resin used in the toner particle has hitherto been made to proceed.

Japanese Patent No. 5132913 describes a technique to improve the low-temperature fixability by using, as a binder resin for a toner particle, a polyester resin synthesized in the presence of a compound having a functional group reacting with an acid or an alcohol and a long-chain alkyl group. In this polyester, the aforementioned compound is incorporated as a constitutional unit.

However, the charge control agents described in Japanese Patent No. 3986488 and Japanese Patent Application Laid-Open No. 2012-215857 are high in charging capability, and hence the charge amount distribution of the toner tends to be broad. When the charge amount distribution of the toner is broad, in particular, in a low-temperature low-humidity environment, the "scattering" of the toner tends to occur. The "scattering" as referred to herein means the state in which an excessively charged toner scatters into the peripheral non-image area (the area normally not to be developed with the toner) surrounding the image area (the area to be developed with the toner).

There has also been a tendency that the so-called selective development comes to be remarkable in which among the toner particle, particles having relatively small particle sizes tending to have high charge amounts are selectively used for development and particles having relatively large particle sizes are not used for development and accumulated in the developing unit.

When the charge amount distribution of the toner is broad, it comes to be difficult to faithfully reproduce the electrostatic latent image. Consequently, the uniformity of a halftone image is disturbed, the granular feeling of the toner is remarkable, and the image tends to undergo the occurrence of roughness.

Also, as described in Japanese Patent No. 5132913, by allowing polyester to have long chain alkyl groups, the charge amount of the toner tends to be decreased. Consequently, when development is performed by setting the same development contrast, the laid-on amount of the toner in the line area is larger relative to the laid-on amount of the toner in the solid black area, and the line/solid ratio is sometimes degraded (deviates from a predetermined value).

SUMMARY OF THE INVENTION

An object of the present invention is to provide a toner and a two-component developer excellent in low-temperature fixability, suppressed in scattering and roughness, and suppressed in selective development and degradation of the line/solid ratio.

The present invention is a toner including a toner particle containing a binder resin and a charge control agent, wherein the binder resin includes a resin having a polyester unit with at least one aliphatic compound condensed to the terminal thereof, the at least one aliphatic compound being selected from the group consisting of aliphatic monocarboxylic acids each having 30 or more and 102 or less carbon atoms and aliphatic monoalcohols each having 30 or more and 102 or less carbon atoms; and the charge control agent includes the compound represented by the following formula [1]:

Formula [1]

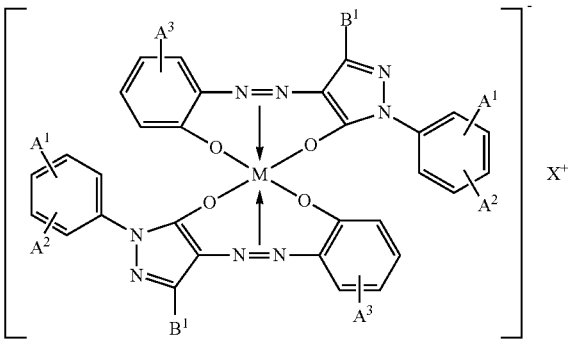

(wherein, in formula [1], $A^1$, $A^2$ and $A^3$ each independently represent a hydrogen atom, a nitro group, or a halogen atom; $B^1$ represents a hydrogen atom or an alkyl group; M represents an iron atom, a chromium atom or an aluminum atom; and $X^+$ represents a hydrogen ion, an alkali metal ion, an ammonium ion or an alkylammonium ion, or mixed ions of two or more of these ions.)

The present invention is also a two-component developer including the aforementioned toner and a carrier.

According to the present invention, it is possible to provide a toner and a two-component developer excellent in low-temperature fixability, suppressed in scattering and roughness, and suppressed in selective development and degradation of the line/solid ratio.

Further features of the present invention will become apparent from the following description of exemplary embodiments.

DESCRIPTION OF THE EMBODIMENTS

Preferred embodiments of the present invention will now be described in detail.

The present inventors have investigated a toner capable of achieving high image quality while pursuing improvement of the low-temperature fixability of the toner. As a result of such an investigation, the present inventors have discovered that achievement of high image quality and improvement of low-temperature fixability can be made by using, as the binder resin of the toner particle, a resin having a polyester unit with at least one aliphatic compound condensed to the terminal thereof, the at least one aliphatic compound being selected from the group consisting of aliphatic monocarboxylic acids having 30 or more and 102 or less carbon atoms and aliphatic monoalcohols having 30 or more and 102 or less carbon atoms, and by using, as the charge control agent for the toner particle, the compound represented by the following formula [1].

Formula [1]

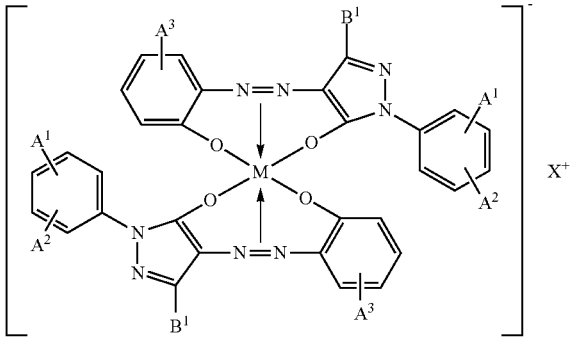

In the formula [1], $A^1$, $A^2$ and $A^3$ each independently represent a hydrogen atom, a nitro group, or a halogen atom; $B^1$ represents a hydrogen atom or an alkyl group; M represents an iron atom, a chromium atom or an aluminum atom; and $X^+$ represents a hydrogen ion, an alkali metal ion, an ammonium ion or an alkylammonium ion, or mixed ions of two or more of these ions, and among these, a hydrogen ion is preferable.

The present inventors infer as follows about the reasons for the fact that the toner having such a constitution as described above achieves excellent effects.

As described above, the binder resin of the toner particle according to the present invention includes a resin having a polyester unit with at least one aliphatic compound condensed to the terminal thereof, the at least one aliphatic compound being selected from the group consisting of aliphatic monocarboxylic acids having 30 or more and 102 or less carbon atoms, and aliphatic monoalcohols having 30 or more and 102 or less carbon atoms.

This means that the carboxy group or the hydroxy group as the terminal group in the polyester unit is capped with the aliphatic compound. In this case, when the polyester unit has branched structure, the "terminal" as referred to herein includes the terminal of the branched portion.

In the aliphatic compound, it is important that the functional group (carboxy group or hydroxy group) is monovalent. By being monovalent, the aliphatic compound is to be condensed with the terminal of the polyester unit. Consequently, the charge control agent can be finely dispersed uniformly in the toner particle and the charge uniformity of the toner can be improved. Consequently, the roughness is suppressed and the degradation of the selective development can be suppressed.

On the other hand, the compound represented by the formula [1] is a complex, and hence Coulomb force may be exerted between the dipole moments possessed by the functional groups (hydroxy groups, carboxy groups, ester groups) of the polyester unit. In particular, the compound represented by the formula [1] is considered to be higher in charging capability than other charge control agents, and accordingly may be strengthened in the interaction with the binder resin.

The terminal groups of the polyester unit have stronger Coulomb force than the ester groups. Accordingly, when a resin with the uncapped terminals of the polyester is used as the binder resin of the toner particle, the charge control agent is considered to strongly interact with the terminal groups of the binder resin. Consequently, it is inferred that the microscopic segregation of the charge control agent occurs, and the microscopic nonuniformity of the charge amount (charge nonuniformity) takes place.

In the constitution of the present invention, the terminal groups of the polyester unit are capped with the relatively large aliphatic compounds, and hence the charge control agent is dispersed in the binder resin so as to be allowed to effectively interact with the ester groups in the polyester unit. Consequently, it is considered that a high charge amount and charge uniformity of the toner are obtained, and hence the scattering and the degradation of the line/solid ratio are suppressed.

The number of the carbon atoms in the aliphatic compound used for the resin having the polyester unit used in the binder resin of the toner particle according to the present invention is 30 or more and 102 or less, and preferably 50 or more and 80 or less. By setting the number of the carbon atoms in the aliphatic compound at 30 or more, the interaction with the uncapped terminal groups of the polyester unit can be sufficiently weakened. Consequently, the low-temperature fixability of the toner is improved. Therewith, the charge control agent can be effectively dispersed in the binder resin, the microscopic charge uniformity is improved, and the scattering is suppressed. On the other hand, by setting the number of the carbon atoms in the aliphatic compound at 102 or less, the terminals of the polyester unit can be effectively capped even with the use of a small amount of the aliphatic compound. Consequently, the microscopic phase segregation of the aliphatic compound can be suppressed. Accordingly, without disturbing the low-temperature fixability of the toner and the interaction between the charge control agent and the binder resin, the charge uniformity of the toner can be improved and the scattering is suppressed.

For the binder resin of the toner particle according to the present invention, the resin having the polyester unit is used. The "polyester unit" as referred to in the present invention means a unit derived from polyester. The "resin having the polyester unit" includes, in addition to the so-called polyester resin, hybrid resins in which the polyester unit and other polymer units (resin units) are chemically bonded to each other. Examples of the resins constituting the other polymer units include: vinyl-based polymers (vinyl-based resins), polyurethanes (polyurethane resins), epoxy-based polymers (epoxy resins) and phenolic polymers (phenolic resins). Among these, the vinyl-based polymers (vinyl-based polymer units) are preferable.

In the present invention, for the binder resin of the toner particle, other resins can be used in combination, in addition to the resins having the polyester unit. Examples of the other resins include vinyl-based resins, polyurethane resins, epoxy resins and phenolic resins.

In the present invention, from the viewpoint of obtaining effective interaction between the ester groups and the charge control agent, the binder resins of the toner particle are preferably all polyester resins and more preferably all are the resins having the polyester unit.

Hereinafter, the components for constituting the polyester unit are described. The following components may be used each alone or in combinations of two or more thereof.

Examples of the dibasic acid component for constituting the polyester unit include the following dicarboxylic acids or the derivatives thereof:

benzene dicarboxylic acids such as phthalic acid, terephthalic acid, isophthalic acid, or the anhydrides thereof or the lower alkyl esters thereof;

alkyl dicarboxylic acids such as succinic acid, adipic acid, sebacic acid and azelaic acid, or the anhydrides thereof or the lower alkyl esters thereof;

alkenylsuccinic acids or alkylsuccinic acids having 1 or more and 50 or less carbon atoms, or the anhydrides thereof or the lower alkyl esters thereof; and unsaturated dicarboxylic acids such as fumaric acid, maleic acid, citraconic acid and itaconic acid, or the anhydrides thereof or the lower alkyl esters thereof.

Examples of the dihydric alcohol components constituting the polyester unit include the following:

ethylene glycol, polyethylene glycol, 1,2-propanediol, 1,3-propanediol, 1,3-butanediol, 1,4-butanediol, 2,3-butanediol, diethylene glycol, triethylene glycol, 1,5-pentanediol, 1,6-hexanediol, neopentyl glycol, 2-methyl-1,3-propanediol, 2-ethyl-1,3-hexanediol, 1,4-cyclohexanedimethanol (CHDM), hydrogenated bisphenol A, and the bisphenol represented by the following formula (I) or the derivatives thereof:

(I)

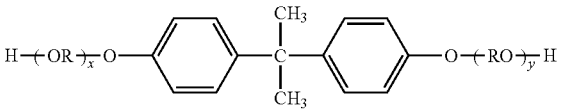

(in formula (I), R represents an ethylene group or a propylene group; x and y are each independently an integer of 0 or more, and the average value of x+y is 0 or more and 10 or less.), and the diols represented by the following formula (II):

(II)

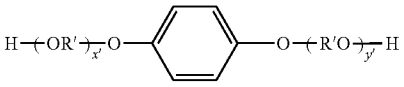

(in formula (II), R' represents

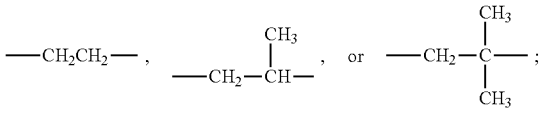

x' and y' are each independently an integer of 0 or more, and the average value of x'+y' is 0 or more and 10 or less.)

As the components for constituting the polyester unit according to the present invention, in addition to the foregoing dibasic carboxylic acid compounds and the foregoing dihydric alcohol compounds, and tri- or more-basic carboxylic acid compounds and tri- or more-hydric alcohol compounds may also be used.

Examples of the tri- or more-basic carboxylic acid compound include trimellitic acid, trimellitic anhydride, and pyromellitic acid. Examples of the tri- or more-hydric alcohol compound include trimethylolpropane, pentaerythritol and glycerin.

The alcohol component for constituting the polyester unit according to the present invention contains an aliphatic polyhydric alcohol preferably in a content of 1 mol % or more and 30 mol % or less, and more preferably in a content of 5 mol % or more and 30 mol % or less. By setting the content of the aliphatic polyhydric alcohol at 1 mol % or more and 30 mol % or less, the concentration of the ester groups in the polyester unit can be made high. Consequently, the interaction between the ester groups and the charge control agent is more effectively obtained.

Examples of the method for producing the polyester unit according to the present invention include the following method.

First, a dibasic carboxylic acid compound and a dihydric alcohol compound are placed in a reactor, simultaneously with an aliphatic monocarboxylic acid or an aliphatic monoalcohol. Then, the esterification reaction, the transesterification reaction, the condensation reaction and the like polymerize these compounds to produce the polyester unit. The polymerization temperature preferably falls within a range of 180° C. or higher and 290° C. or lower. In the polymerization of the polyester unit, polymerization catalysts such as a titanium-based catalyst, a tin-based catalyst, zinc acetate, antimony trioxide and germanium dioxide can be used. In the present invention, the polyester unit is preferably a polyester unit obtained by the polycondensation in the presence of a titanium-based catalyst.

Examples of the titanium-based catalyst include:

titanium diisopropylate bis(triethanol aminate) [$Ti(C_6H_{14}O_3N)_2(C_3H_7O)_2$], titanium diisopropylate bis(diethanol aminate) [$Ti(C_4H_{10}O_2N)_2(C_3H_7O)_2$], titanium dipentylate bis(triethanol aminate) [$Ti(C_6H_{14}O_3N)_2(C_5H_{11}O)_2$], titanium diethylate bis(triethanol aminate) [$Ti(C_6H_{14}O_3N)_2(C_2H_5O)_2$], titanium dihydroxyoctylate bis(triethanol animate) [$Ti(C_6H_{14}O_3N)_2(OHC_8H_{16}O)_2$], titanium distearate bis(triethanol aminate) [$Ti(C_6H_{14}O_3N)_2(C_{18}H_{37}O)_2$], titanium triisopropylate triethanol aminate [$Ti(C_6H_{14}O_3N)_1(C_3H_7O)_3$], titanium monopropylate tris(triethanol aminate) [$Ti(C_6H_{14}O_3N)_3(C_3H_2O)_2$], tetra-n-butyl titanate [$Ti(C_4H_9O)_4$], tetrapropyl titanate [$Ti(C_3H_2O)_4$], tetrastearyl titanate [$Ti(C_{18}H_{32}O)_4$], tetramyristyl titanate [$Ti(C_{14}H_{29}O)_4$],
tetraoctyl titanate [$Ti(C_8H_{12}O)_4$],
dioctyl dihydroxyoctyl titanate [$Ti(C_8H_{12}O)_2$ $(OHC_8H_{16}O)_2$] and
dimyristyl dioctyl titanate [$Ti(C_{14}H_{29}O)_2(C_8H_{17}O)_2$].

Among these, titanium diisopropylate bis(triethanol aminate), titanium diisopropylate bis(diethanol aminate), titanium dipentylate bis(triethanol aminate), tetrastearyl titanate, tetramyristyl titanate, tetraoctyl titanate, dioctyl dihydroxyoctyl titanate are preferable.

These can be obtained, for example, by allowing a titanium halide and an alcohol corresponding to the intended product to react with each other.

The titanium-based catalyst preferably contains an aromatic carboxylic acid titanium compound.

The aromatic carboxylic acid titanium compound is preferably a product obtained by allowing an aromatic carboxylic acid and a titanium alkoxide to react with each other.

The aromatic carboxylic acid is preferably a di- or more-basic aromatic carboxylic acid (namely, an aromatic carboxylic acid having two or more carboxy groups) and/or an aromatic oxycarboxylic acid.

Examples of the di- or more-basic aromatic carboxylic acid include:

dicarboxylic acids such as phthalic acid, isophthalic acid and terephthalic acid, or the anhydrides thereof; and polybasic carboxylic acids such as trimellitic acid, benzophenonedicarboxylic acid, benzophenonetetracarboxylic acid, naphthalenedicarboxylic acid and naphthalenetetracarboxylic acid, or the anhydrides thereof or the ester compounds thereof.

Among these, isophthalic acid, terephthalic acid, trimellitic acid and naphthalenedicarboxylic are preferable.

Examples of the aromatic oxycarboxylic acid include salicylic acid, m-oxybenzoic acid, p-oxybenzoic acid, gallic acid, mandelic acid and tropic acid.

As described above, in the present invention, the resin having the polyester unit includes the hybrid resins in which the polyester unit and other polymer units are chemically bonded to each other. Among the hybrid resins, a hybrid resin in which the polyester unit and the vinyl-based polymer unit are chemically bonded to each other is preferable.

Examples of the vinyl-based monomer for constituting the vinyl-based polymer unit in the hybrid resin include a styrene-based monomer and a (meth)acrylic acid-based monomer. Among these, the styrene-based monomer is preferable, and styrene is more preferable. The proportion of the aromatic ring in the molecular structure of styrene is large, and hence styrene more improves the durable stability of the toner. The content of styrene in the vinyl-based monomer is preferably 70 mol % or more and more preferably 85 mol % or more.

Examples of the styrene-based monomer include: styrene; and styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene.

Examples of the acrylic acid-based monomer include:

acrylic acid and acrylic acid esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate;

methacrylic acid and methacrylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate;

α-methylenealiphatic monocarboxylic acids and the esters thereof (amino esters of methacrylic acid) such as dimethylaminoethyl methacrylate and diethylaminoethyl methacrylate; and derivatives of acrylic acid or methacrylic acid such as acrylonitrile, methacrylonitrile and acrylamide.

Examples of the monomers for constituting the vinyl-based polymer unit include:

esters of acrylic acid or methacrylic acid such as 2-hydroxyethyl acrylate, 2-hydroxy-ethyl methacrylate and 2-hydroxy-propyl methacrylate; and hydroxy group-containing monomers such as 4-(1-hydroxy-1-methylbutyl)styrene and 4-(1-hydroxy-1-methylhexyl) styrene.

For the vinyl-based polymer unit, monomers capable of performing vinyl polymerization, other than the foregoing monomers can also be used.

Examples of the monomers capable of performing vinyl polymerization, other than the foregoing monomer, include:

ethylene-based unsaturated monoolefins such as ethylene, propylene, butylene and isobutylene;

unsaturated polyenes such as butadiene and isoprene;

halogenated vinyls such as vinyl chloride, vinylidene chloride, vinyl bromide and vinyl fluoride;

vinyl esters such as vinyl acetate, vinyl propionate and vinyl benzoate;

vinyl ethers such as vinyl methyl ether, vinyl ethyl ether and vinyl isobutyl ether;

vinyl ketones such as vinyl methyl ketone, vinyl hexyl ketone and methyl isopropenyl ketone;

N-vinyl compounds such as N-vinylpyrrole, N-vinylcarbazole, N-vinylindole and N-vinylpyrrolidone;

vinylnaphthalenes;

unsaturated dibasic acids such as maleic acid, citraconic acid, itaconic acid, alkenylsuccinic acid, fumaric acid and mesaconic acid;

anhydrides of unsaturated dibasic acids such as maleic anhydride, citraconic anhydride, itaconic anhydride and alkenylsuccinic anhydride;

unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester and mesaconic acid methyl half ester;

unsaturated dibasic acid esters such as dimethyl maleate and dimethyl fumarate;

anhydrides of α,β-unsaturated acids such as acrylic acid, methacrylic acid, crotonic acid and cinnamic acid;

anhydrides between α,β-unsaturated acids and lower fatty acids; and carboxy group-containing monomers such as alkenyl malonate, alkenyl glutarate, alkenyl adipate, or acid anhydrides or monoesters of these.

For the vinyl-based polymer unit, cross-linking monomers can also be used.

Examples of the cross-linking monomer include: aromatic divinyl compounds, diacrylate compounds linked with an alkyl chain, diacrylate compounds linked with an ether bond-containing alkyl chain, diacrylate compounds linked with an aromatic group and ether bond-containing chain, polyester-type diacrylates, and polyfunctional cross-linking agents.

Examples of the aromatic divinyl compounds include divinylbenzene and divinylnaphthalene.

Examples of the diacrylate compounds linked with an alkyl chain include: ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, ethylene glycol dimethacrylate, 1,3-butylene glycol dimethacrylate, 1,4-butanediol dimethacrylate, 1,5-pentanediol dimethacrylate, 1,6-hexanediol dimethacrylate and neopentyl glycol dimethacrylate.

Examples of the diacrylate compounds linked with an ether bond-containing alkyl chain include: diethylene glycol diacrylate, triethylene glycol diacrylate, tetraethylene glycol diacrylate, polyethylene glycol #400 diacrylate, polyethylene glycol #600 diacrylate, dipropylene glycol diacrylate, diethylene glycol dimethacrylate, triethylene glycol dimethacrylate, tetraethylene glycol dimethacrylate, polyethylene glycol #400 dimethacrylate, polyethylene glycol #600 dimethacrylate and dipropylene glycol dimethacrylate.

Examples of the diacrylate compounds linked with an aromatic group and ether bond-containing chain include: polyoxyethylene (2)-2,2-bis(4-hydroxyphenyl)propane diacrylate, polyoxyethylene (4)-2,2-bis(4-hydroxyphenyl)propane diacrylate, polyoxyethylene (2)-2,2-bis(4-hydroxyphenyl)propane dimethacrylate and polyoxyethylene (4)-2,2-bis(4-hydroxyphenyl)propane dimethacrylate.

Examples of the polyester-type diacrylates include MANDA (trade name) manufactured by Nippon Kayaku Co., Ltd.

Examples of the polyfunctional cross-linking agents include: pentaerythritol triacrylate, trimethylolethane triacrylate, trimethylolpropane triacrylate, tetramethylolmethane tetraacrylate, oligoester acrylate, pentaerythritol trimethacrylate, trimethylolethane trimethacrylate, trimethylolpropane trimethacrylate, tetramethylolmethane tetramethacrylate, oligoester methacrylate, triallyl cyanurate and triallyl trimellitate.

The vinyl-based polymer unit may be a polymer produced by using a polymerization initiator. The amount used of the polymerization initiator is preferably 0.05 part by mass or more and 10 parts by mass or less in relation to 100 parts by mass of the vinyl-based monomer, from the viewpoint of the polymerization efficiency.

Examples of the polymerization initiator include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl 2,2'-azobisisobutyrate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile and 2,2'-azobis(2-methylpropane); ketone peroxides such as methyl ethyl ketone peroxide, acetylacetone peroxide and cyclohexanone peroxide; 2,2-bis(t-butylperoxy)butane, t-butylhydroperoxide, cumene hydroperoxide, 1,1,3,3-tetramethylbutyl hydroperoxide, di-t-butylperoxide, t-butylcumylperoxide, dicumylperoxide, α,α'-bis(t-butylperoxyisopropyl)benzene, isobutylperoxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate and di-t-butyl peroxyazelate.

In the production of a hybrid resin in which the polyester unit and the vinyl-based polymer unit are chemically bonded to each other, it is preferable to perform the polymerization by using a compound (hereinafter, also denoted as a "double-reactive compound") capable of reacting with both of the monomers for constituting both polymers respectively.

Examples of the double-reactive compound include: fumaric acid, acrylic acid, methacrylic acid, citraconic acid, maleic acid and dimethyl fumarate. Among these, fumaric acid, acrylic acid and methacrylic acid are preferable.

Examples of the method for producing the hybrid resin in which the polyester unit and the vinyl-based polymer unit are chemically bonded to each other include the following method.

Specifically, the hybrid resin can be produced by allowing the monomers for constituting the polyester unit and the vinyl-based monomers for constituting the vinyl-based polymer unit to simultaneously react with each other, or alternatively by allowing both monomers to successively react with each other. When the vinyl-based monomers are subjected to addition polymerization reaction, and then the monomers for constituting the polyester unit are subjected to polycondensation reaction, the control of the molecular weight of the hybrid resin is easy.

In the hybrid resin in which the polyester unit and the vinyl-based polymer unit are chemically bonded to each other, the mass ratio of the polyester unit to the vinyl-based polymer unit is preferably 50/50 or more and 90/10 or less, from the viewpoint of the molecular-level control of the cross-linked structure. The mass ratio is more preferably 50/50 or more and 80/20 or less. The inclusion of the polyester unit in the hybrid resin in a content of 50% by mass or more improves the low-temperature fixability of the toner. The inclusion of the vinyl-based polymer unit in the hybrid resin in a content of 10% by mass or more improves the charge uniformity.

The aliphatic compound according to the present invention is at least one selected from the group consisting of the aliphatic monocarboxylic acids having 30 or more and 102 or less carbon atoms and the aliphatic monoalcohols having 30 or more and 102 or less carbon atoms. As the aliphatic monocarboxylic acids and the aliphatic monoalcohols, any of the primary, secondary and the tertiary types can be used.

Examples of the aliphatic monocarboxylic acid include melissic acid, lacceric acid, tetracontanoic acid and pentacontanoic acid.

Examples of the aliphatic monoalcohol include melissyl alcohol and tetracontanol.

For the aliphatic compound according to the present invention, modified waxes obtained by acid-modifying or alcohol-modifying aliphatic hydrocarbon-based waxes can also be used. A modified wax sometimes includes zero-valent modified waxes, monovalent modified waxes and divalent or more modified waxes; in the modified wax mixture, the content of the monovalent modified waxes (monocarboxylic acids or monoalcohols) is preferably 50% by mass or more.

Examples of the acid-modified aliphatic hydrocarbon-based wax include: polyethylene or polypropylene modified with a monobasic unsaturated carboxylic acid such as acrylic acid.

Of the alcohol-modified aliphatic hydrocarbon-based waxes, a primary alcohol-modified aliphatic hydrocarbon-based wax can be produced by, for example, the following method. First, polyethylene is obtained by polymerizing ethylene with the Ziegler catalyst. After the completion of the polymerization, the reaction mixture is oxidized to produce an alkoxide between the catalyst metal and polyethylene, then the oxidized reaction mixture is hydrolyzed, and thus a primary alcohol-modified aliphatic hydrocarbon-based wax can be produced.

Of the alcohol-modified aliphatic hydrocarbon-based waxes, a secondary alcohol-modified aliphatic hydrocarbon-based wax can be produced by, for example, the following method. A secondary alcohol-modified aliphatic hydrocarbon-based wax is obtained by liquid phase oxidation of an aliphatic hydrocarbon-based waxes with molecular oxygen-containing gas in the presence of boric acid and anhydrous boric acid. The obtained secondary alcohol-modified aliphatic hydrocarbon-based wax may further be subjected to purification by press sweating, purification by using a solvent, hydrogenation treatment and treatment with activated clay after cleaning with sulfuric acid. As the catalyst, a mixture composed of boric acid and anhydrous boric acid can also be used. The molar ratio (boric acid/anhydrous boric acid) of boric acid to anhydrous boric acid is preferably 1.0/1.0 or more and 2.0/1.0 or less, and more preferably, 1.2/1.0 or more and 1.7/1.0 or less. With the increase of the proportion of anhydrous boric acid, the aggregation phenomenon due to the excess fraction of boric acid is made harder to occur. With the decrease of the proportion of anhydrous boric acid, the amount of the powder derived from anhydrous boric acid, occurring after the reaction, is reduced, and the anhydrous boric acid fraction hard to contribute to the reaction is reduced.

The amount used of the mixture composed of boric acid and anhydrous boric acid per 1 mol aliphatic hydrocarbon wax as raw materials, in terms of the amount of boric acid that is converted from the mixture, is preferably 0.001 mole or more and 10 moles or less, and more preferably 0.1 mole or more and 1 mole or less.

Examples of the catalyst other than boric acid/anhydrous boric acid include metaboric acid and pyroboric acid.

Examples of the acid to form an ester with an alcohol include an oxoacid of boron, an oxoacid of phosphorus and an oxoacid of sulfur. More specific examples include boric acid, nitric acid, phosphoric acid and sulfuric acid.

Examples of the molecular oxygen-containing gas include oxygen gas, air, or the gases obtained by diluting these gases with inert gases. The oxygen concentration in the molecular oxygen-containing gas is preferably 1 vol % or more and 30 vol % or less and more preferably 3 vol % or more and 20 vol % or less.

The liquid phase oxidation reaction is usually performed in a molten state of the aliphatic hydrocarbon-based wax, which is a starting material, without using any solvent. The reaction temperature is preferably 120° C. or higher and 280° C. or lower, and more preferably 150° C. or higher and 250° C. or lower. The reaction time is 1 hour or more and 15 hours or less.

It is preferable to add, to the reaction system, boric acid and anhydrous boric acid in a state of being preliminarily mixed with each other. By preliminarily mixing boric acid and anhydrous boric acid, the dehydration reaction of boric acid is made hard to occur.

The addition temperature (the temperature at the time of addition to the reaction system) of the mixed catalyst composed of boric acid and anhydrous boric acid is preferably 100° C. or higher and 180° C. or lower, and more preferably 110° C. or higher and 160° C. or lower. When the addition temperature of the mixed catalyst is 100° C. or higher, moisture is made hard to remain in the reaction system, and thus the degradation of the catalytic activity of anhydrous boric acid due to moisture is made hard to occur.

After the completion of the reaction, the boric acid ester of the produced aliphatic hydrocarbon-based wax is hydrolyzed by adding water to the reaction mixture, and the produced aliphatic hydrocarbon-based wax is purified to yield an alcohol-modified aliphatic hydrocarbon-based wax.

In the aliphatic compound according to the present invention, an aliphatic monocarboxylic acid having 30 or more and 102 or less carbon atoms and/or an aliphatic monoalcohol having 30 or more and 102 or less carbon atoms is used; among these, the aliphatic monoalcohol having 30 or more and 102 or less carbon atoms is preferable. Of the carboxy groups and the hydroxy groups, which are the terminal groups of the polyester unit, the carboxy groups tend to form stronger hydrogen bonds than the hydroxy groups. Accordingly, by capping the carboxy groups with aliphatic monoalcohols, the interaction between the terminal groups of the polyester unit and the charge control agent can be more effectively weakened. Consequently, the microscopic segregation of the charge control agent can be suppressed, and the charge uniformity of the toner is more improved.

By condensing the aliphatic compound with the terminals of the polyester unit, the moiety derived from the aliphatic compound is enabled to partially plasticize the polyester unit, and hence the low-temperature fixability of the toner can be improved.

Examples of the method for condensing the aliphatic compound with the terminals of the polyester unit include the following method. Here is quoted a method in which in the production of the resin having the polyester unit, polycondensation is performed under the condition that the aliphatic compound is added together with the monomer for constituting the polyester unit possessed by the resin. By adopting this method, the aliphatic compound can be sufficiently condensed with the terminals of the polyester unit possessed by the resin.

The amount used of the aliphatic compound is preferably 0.1 part by mass or more and 10 parts by mass or less, more preferably 1 part by mass or more and 10 parts by mass or less and furthermore preferably 2 parts by mass or more and 7 parts by mass or less, in relation to 100 parts by mass of the total mass of the binder resin of the toner particle. The amount of the aliphatic compound falling within the foregoing range enhances the plasticizing effect on the binder resin, and more improves the low-temperature fixability.

For the binder resin of the toner particle according to the present invention, resins other than the resin having the polyester unit may also be used in combinations. Such other resins are preferably polyester resin and a hybrid resin in which the polyester unit and other polymer units are chemically bonded to each other, in the viewpoint of obtaining the sufficient effect of the present invention.

The resins other than the resins having the polyester unit are preferably resins having the polyester units with the same aliphatic compound as the foregoing aliphatic compound, condensed with the terminals thereof. The presence of the moieties derived from the aliphatic compound in the resins other than the resin having the polyester unit enhances the mutual compatibilities between the resins. Consequently, the low-temperature fixability of the toner is more improved, and the charge control agent can also be finely dispersed uniformly in the toner particle.

When the resins other than the resin having the polyester unit are used in combinations, it is preferable to use the other resins in such a way that the proportion of the polyester unit is 60% by mass or more in relation to the binder resin. The proportion of the polyester unit of 60% by mass or more in the binder resin allows the ester groups in the polyester unit and the charge control agent to effectively interact with each other to more improve the charge uniformity of the toner.

In a system using a plurality of resins in combination as the binder resin, the softening point (Tm) of the high softening point resin is preferably 120° C. or higher and 170° C. or lower; and the softening point (Tm) of the low softening point resin is preferably 70° C. or higher and 120° C. or lower.

Preferably, the combinational use of a plurality of resins as the binder resin allows the design of the molecular weight distribution of the binder resin in the toner particle to be performed easily, and allows the toner to have a broad fixing region.

When a resin is used alone as the binder resin, the softening point (Tm) of the resin is preferably 95° C. or higher and 170° C. or lower, and more preferably 120° C. or higher and 160° C. or lower. When the softening point (Tm) of the binder resin falls within a range of 120° C. or higher and 160° C. or lower, the balance between the high-temperature offset resistance and the low-temperature fixability of the toner is more satisfactory.

In the present invention, the softening point was measured as follows.

The measurement of the softening point of a resin was performed by using a constant-load extruding type capillary rheometer (trade name: Rheological Property Evaluation Apparatus, Flow Tester CFT-500D, manufactured by Shimadzu Corp.), according to the manual appended to the flow property evaluation apparatus. In the rheological property evaluation apparatus, while a constant load is being applied from the upper portion of a measurement sample, the measurement sample filled in a cylinder can be increased in temperature to be melted. From a die at the bottom of the cylinder, the molten measurement sample is extruded, and it is possible to obtain a rheological curve representing the relation between the downward displacement of the piston in this extrusion and the temperature.

In the present invention, the "melting temperature in the ½ method" described in the manual appended to the rheological property evaluation apparatus was taken as the softening point. The melting temperature in the ½ method are calculated as follows.

At the beginning, the ½ of the difference between the downward displacement Smax of the piston at the time of completion of the flowing out and the downward displacement Smin of the piston at the time of the start of the flowing out is calculated (the ½ of the difference is denoted by X; X=(Smax−Smin)/2). In the rheological curve, the temperature at which the downward displacement of the piston is the sum of X and Smin is the melting temperature (Tm) (=softening point) in the ½ method.

As the measurement sample of the softening point (Tm) of a resin, a cylinder-shaped sample of 8 mm in diameter was used which was obtained by compression molding 1.0 g of a measurement sample into a cylindrical shape, under a pressure of 10 MPa for 60 seconds in an environment of 25° C. by using a tablet-molding compressor (trade name: NT-100H) manufactured by NPa System Co., Ltd.

The measurement conditions of the rheological property evaluation apparatus is as follows.

Test mode: Temperature increase method
Start temperature: 50° C.
Target temperature: 200° C.
Measurement interval: 1.0° C.
Temperature increase rate: 4.0° C./min
Cross-sectional area of piston: 1.000 $cm^2$
Test load (load exerted by piston): 10.0 kgf (0.9807 MPa)
Preheating time: 300 seconds
Die hole diameter: 1.0 mm
Die length: 1.0 mm The glass transition temperature (Tg) of the binder resin is preferably 45° C. or higher from the viewpoint of the storage stability of the toner. Additionally, the glass transition temperature (Tg) of the binder resin is preferably 75° C. or lower and more preferably 65° C. or lower, from the viewpoint of the low-temperature fixability.

The glass transition temperature (Tg) of the binder resin of the toner particle was measured at normal temperature under normal pressure by using a differential scanning colorimeter (DSC) (trade name: MDSC-2920,) manufactured by TA Instruments Japan Inc., according to ASTM D3418-82. The resin (binder resin), the measurement sample is weighed precisely in an amount of 3 mg to be used. The weighed resin is placed in an aluminum pan, and an empty aluminum pan is used as a reference. The measurement temperature range is set to be 30° C. or higher and 200° C. or lower; once the temperature is increased from 30° C. to 200° C. at a temperature increase rate of 10° C./min, then the temperature is decreased from 200° C. to 30° C. at a temperature decrease rate of 10° C./min, and then the temperature is again increased to 200° C. at a temperature increase rate of 10° C./min. In the DSC curve obtained in the second temperature increase process, an intermediate line is drawn between the base lines before and after the occurrence of the change of specific heat to obtain an intersection with the DSC curve; the temperature at the intersection is taken as the glass transition temperature (Tg) of the resin (binder resin) as the measurement sample.

The charge control agent according to the present invention includes the compound represented by the following formula [1]:

Formula [1]

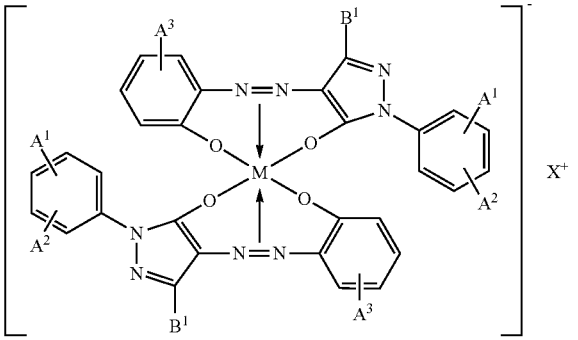

In the formula [1], $A^1$, $A^2$ and $A^3$ each independently represent a hydrogen atom, a nitro group, or a halogen atom, and among these, a halogen atom is preferable, and in particular, a chlorine atom is preferable; $B^1$ represents a hydrogen atom or an alkyl group, and among these, an alkyl group is preferably, and in particular, a methyl group is preferable. M represents an iron atom, a chromium atom or an aluminum atom, and among these, an iron atom is preferable; $X^+$ represents a hydrogen ion, an alkali metal ion, an ammonium ion or an alkylammonium ion, or mixed ions of two or more of these ions, and among these, a hydrogen ion is preferable.

The compound represented by the formula [1] (pyrazolone monoazo metal compound) can be produced by, for example, the following production method.

First, to the amine component such as 4-chloro-2-aminophenol, a mineral acid such as hydrochloric acid or sulfuric acid is added; when the solution temperature comes to be 5° C. or lower, sodium nitrite dissolved in water is dropwise added to the solution while the solution temperature is being maintained at 10° C. or lower. The reaction solution is stirred and allowed to react at 10° C. or lower for 30 minutes or more and 3 hours or less, and a diazo compound is obtained by diazotizing 4-chloro-2-aminophenol. Next, sulfamic acid is added to the reaction solution, and with potassium iodide starch paper, it is verified that no excessive nitrous acid remains.

Next, 3-methyl-1-(3,4-dichlorophenyl)-5-pyrazolone as a coupling component, a sodium hydroxide aqueous solution, sodium carbonate and an organic solvent are mixed, and stirred at room temperature to dissolve the soluble components. The resulting diazo compound is added to the resulting reaction solution, and the resulting reaction solution is stirred at room temperature for several hours to allow the coupling reaction to be performed. After stirring, resorcinol is added to the reaction solution, the completion of the reaction between the diazo compound and resorcinol is verified, and thus, the reaction is terminated. After the termination of the reaction, water is added to the reaction solution; the reaction solution is sufficiently stirred, allowed to stand still, and then subjected to liquid separation. Further, sodium hydroxide aqueous solution is added to the separated solution and the separated solution is stirred for cleaning, and the resulting solution is subjected to liquid separation. In this way, a monoazo compound solution is obtained. Examples of the organic solvent used in the coupling reaction include monohydric alcohols, dihydric alcohols and ketone-based organic solvents.

Examples of the monohydric alcohol include methanol, ethanol, n-propanol, 2-propanol, n-butanol, isobutyl alcohol, sec-butyl alcohol, n-amyl alcohol, isoamyl alcohol and ethylene glycol monoalkyl (number of carbon atoms: 1 or more and 4 or less) ethers.

Examples of the dihydric alcohols include ethylene glycol and propylene glycol.

Examples of the ketone-based organic solvent include methyl ethyl ketone and methyl isobutyl ketone.

Next, the metalation reaction is performed. Water, salicylic acid, n-butanol and sodium carbonate are added to the monoazo compound solution and the monoazo compound solution is stirred. When an iron atom is adopted as the coordination metal atom, a ferric chloride aqueous solution and sodium carbonate are added.

The solution temperature is increased so as to fall within the range of 30° C. or higher and 40° C. or lower, and the reaction is pursued by TLC (Thin-Layer Chromatography). After an elapsed time of 5 hours to 10 hours, the disappearance of the spots of the starting materials is verified, and then the reaction is terminated. After the termination of the reaction, stirring is ceased, the reaction solution is allowed to stand still, and subjected to liquid separation. Water, n-butanol and a sodium hydroxide aqueous solution are added to the separated solution, and alkali cleaning of the solution was performed. Next, the solution is filtered, and cakes are taken out and washed with water.

The cakes washed with water are dissolved in an organic solvent. Examples of the organic solvent used in this case include dimethyl sulfoxide, N,N-dimethylformamide, a monohydric alcohol and a dihydric alcohol.

Examples of the monohydric alcohol include: methanol, ethanol, n-propanol, 2-propanol, n-butanol, isobutyl alcohol, sec-butyl alcohol, n-amyl alcohol, isoamyl alcohol, ethylene glycol monoalkyl (number of carbon atoms: 1 or more and 4 or less) ethers.

Examples of the dihydric alcohol include ethylene glycol and propylene glycol.

The resulting solution is increased in temperature to 50° C., water is added to the solution under stirring, and thus the charge control agent (the compound represented by the formula [1]) is slowly precipitated. When a defoaming agent is beforehand added to water, the foam generated in the reaction system can be removed, and the charge control agent can be made uniform. Next, the solution is cooled and filtered, the cakes are washed with water, the cakes are dried (vacuum dried), and thus the compound (pyrazolone monoazo metal compound) represented by the formula [1] can be obtained.

The compound represented by the formula [1] is preferably a compound (monoazo iron compound) represented by the following formula [2].

Formula [2]

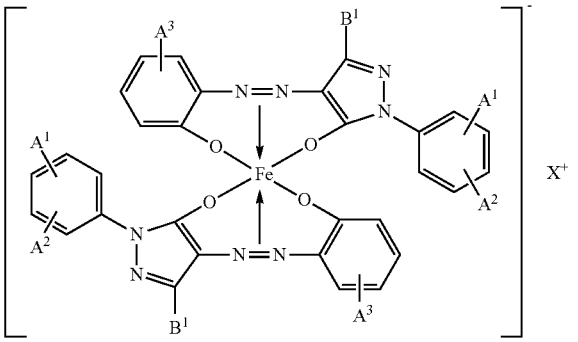

In the formula [2], $A^1$, $A^2$ and $A^3$ each independently represent a hydrogen atom, a nitro group, or a halogen atom; $B^1$ represents a hydrogen atom or an alkyl group; and $X^+$ represents a hydrogen ion, an alkali metal ion, an ammonium ion or an alkylammonium ion, or mixed ions of two or more of these ions.

Of the compounds represented by the formula [1], the compound represented by the formula [2] is the compound in which M in the formula [1] is an iron atom. The adoption of an iron atom as M (coordination metal atom) allows the toner to be provided with excellent charge stability over a long term. Consequently, the degradation of the line/solid ratio can be suppressed.

The compound represented by the formula [2] is preferably a compound (monoazo iron compound) represented by the following formula [3].

Formula [3]

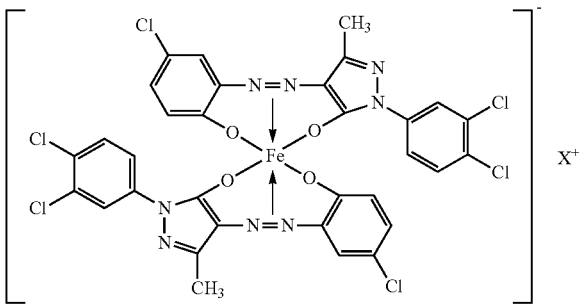

In the formula [3], $X^+$ represents a hydrogen ion, an alkali metal ion, an ammonium ion or an alkylammonium ion, or mixed ions of two or more of these ions.

Of the compounds represented by the formula [2], the compound represented by the formula [3] is the compound in which $B^1$ in the formula [2] is a methyl group, $A^1$, $A^2$ and $A^3$ are each a chlorine atom, and the substitution positions of the chlorine atoms are located at specific positions. By adopting the structure represented by the formula [3], the charge amount distribution of the toner is made sharper, and the degradation of the selective development can be suppressed.

The volume average particle size of the charge control agent according to the present invention is preferably 0.5 μm or more and 3.0 μm or less. By setting the volume average particle size of the charge control agent so as to fall within a range of 0.5 μm or more and 3.0 μm or less, the dispersibility of the charge control agent in the binder resin is improved.

In the present invention, the volume average particle size (particle size distribution) of the charge control was measured as follows.

The particle size of the charge control agent was measured by using a laser diffraction particle size distribution analyzer (trade name: Coulter LS-230 Particle Size Distribution Analyzer) manufactured by Beckman-Coulter, Inc. Ethanol was used as the measurement solvent. The interior of the measurement system of the particle size distribution analyzer was washed with ethanol several times, the air in the interior of the measurement system is replaced with ethanol, and the background function was performed.

Next, a sample solution was obtained as follows, and the sample solution was slowly added in the measurement system of the particle size distribution analyzer. The measurement was performed by regulating the sample concentration in the measurement system in such a way that the PIDS (concentration) on the screen of the particle size distribution analyzer was 45% or more and 55% or less, and the frequency ratio was obtained from the distribution calculated from the volume distribution.

The measurement was performed by setting the refractive index of ethanol at 1.36 as the device coefficient, and at 1.08 (real part)-0.001 (imaginary part) as the optical model. The particle size measurement range of the particle size distribution analyzer is 0.04 μm or more and 2000 μm or less. The measurement temperature was set to fall within a range of 20° C. or higher and 25° C. or lower.

The method for preparing the measurement sample in the present invention was as follows: the fine particles of the measurement object were weighed in an amount of 0.4 g, placed in a beaker containing 100 mL of ethanol, stirred for 1 minute by stirring with a stirrer, and thus adapted to ethanol. The beaker is transferred to an ultrasonic vibrating trough and the content of the beaker was treated for 3 minutes to prepare a dispersion. Immediately after the completion of the treatment, the dispersion was added to the measurement section filled with ethanol until the measurement-permissible concentration was reached, and then the measurement was started.

As the ultrasonic vibrating trough, the Ultrasonic Cleaner VS-150 (trade name) (frequency: 50 kHz, maximum output power: 150 W) manufactured by ASONE Corp. (former company name: Iuchi Seieido Co., Ltd.) was used.

The measurement sample concentration in the measurement is the concentration being suitable for the observation of the aggregation and dispersion of fine particles and enabling accurate observation of the particle size distribution of fine particles. When a measurement sample small in particle size or low in aggregability is measured, the amount of the measurement sample may be set at 0.2 g and the amount of ethanol may also be set at 50 mL.

In the foregoing particle size distribution analyzer, at first, the particle sizes of the individual particles are determined, and then the determined particle sizes are distributed to the following channels. Then, the median particle size in each of the channels was taken as the representative value of the channel concerned, a sphere having the representative value as the diameter thereof is assumed, and on the basis of such spheres, the particle size distribution based on volume is determined.

TABLE 1

| Particle size (μm) |
|---|
| 0.040 or more and less than 0.044 |
| 0.044-0.048 |
| 0.048-0.053 |
| 0.053-0.058 |
| 0.058-0.064 |
| 0.064-0.070 |
| 0.070-0.077 |
| 0.077-0.084 |
| 0.084-0.093 |
| 0.093-0.102 |
| 0.102-0.112 |
| 0.112-0.122 |
| 0.122-0.134 |
| 0.134-0.148 |
| 0.148-0.162 |
| 0.162-0.178 |
| 0.178-0.195 |
| 0.195-0.214 |
| 0.214-0.235 |
| 0.235-0.258 |
| 0.258-0.284 |
| 0.284-0.311 |
| 0.311-0.342 |
| 0.342-0.375 |
| 0.375-0.412 |
| 0.412-0.452 |
| 0.452-0.496 |
| 0.496-0.545 |
| 0.545-0.598 |
| 0.598-0.657 |
| 0.657-0.721 |
| 0.721-0.791 |
| 0.791-0.869 |
| 0.869-0.953 |
| 0.953-1.047 |
| 1.047-1.149 |
| 1.149-1.261 |
| 1.261-1.385 |
| 1.385-1.520 |

TABLE 1-continued

| Particle size (μm) |
|---|
| 1.520-1.669 |
| 1.669-1.832 |
| 1.832-2.010 |
| 2.010-2.207 |
| 2.207-2.423 |
| 2.423-2.660 |
| 2.660-2.920 |
| 2.920-3.206 |
| 3.206-3.519 |
| 3.519-3.862 |
| 3.862-4.241 |
| 4.241-4.656 |
| 4.656-5.111 |
| 5.111-5.611 |
| 5.611-6.158 |
| 6.158-6.761 |
| 6.761-7.421 |
| 7.421-8.147 |
| 8.147-8.944 |
| 8.944-9.819 |
| 9.819-10.78 |
| 10.78-11.83 |
| 11.83-12.99 |
| 12.99-14.26 |
| 14.26-15.65 |
| 15.65-17.18 |
| 17.18-18.86 |
| 18.86-20.70 |
| 20.70-22.73 |
| 22.73-24.95 |
| 24.95-27.38 |
| 27.38-30.07 |
| 30.07-33.00 |
| 33.00-36.24 |
| 36.24-39.77 |
| 39.77-43.66 |
| 43.66-47.93 |
| 47.93-52.63 |
| 52.63-57.77 |
| 57.77-63.41 |
| 63.41-69.62 |
| 69.62-76.43 |
| 76.43-83.90 |
| 83.90-92.09 |
| 92.09-101.1 |
| 101.1-111.0 |
| 111.0-121.8 |
| 121.8-133.7 |
| 133.7-146.8 |
| 146.8-161.2 |
| 161.2-176.8 |
| 176.8-194.2 |
| 194.2-213.2 |
| 213.2-234.1 |
| 234.1-256.8 |
| 256.8-282.1 |
| 282.1-309.6 |
| 309.6-339.8 |
| 339.8-373.1 |
| 373.1-409.6 |
| 409.6-449.7 |
| 449.7-493.6 |
| 493.6-541.9 |
| 541.9-594.9 |
| 594.9-653.0 |
| 653.0-716.9 |
| 716.9-786.9 |
| 786.9-863.9 |
| 863.9-948.2 |
| 948.2-1041 |
| 1041-1143 |
| 1143-1255 |
| 1255-1377 |
| 1377-1512 |
| 1512-1660 |
| 1660-1822 |
| 1822-2000 |

The charge control agent according to the present invention contains an acetic acid ester in a content of preferably 1 ppm or more and 1000 ppm or less, and more preferably 1 ppm or more and 500 ppm or less, and furthermore preferably 1 ppm or more and 300 ppm or less. The inclusion of an acetic acid ester in the charge control agent in the foregoing amount improves the chargeability of the toner (a high charge amount is obtained). The reason for this is not clear at present, and is interpreted as follows.

When the toner particle is the toner particle obtained by a kneading and pulverizing method, most of the acetic acid ester contained in the charge control agent according to the present invention volatilizes in the kneading step (melt kneading step) in the production of the toner particle. When the acetic acid ester volatilizes, the acetic acid ester volatilizes from the interface between the charge control agent and the binder resin contained in the toner particle, and hence the volatilization of the acetic acid ester acts to weaken the adhesiveness between the binder resin and the charge control agent. Accordingly, in the pulverizing step after the kneading step, the kneaded product tends to be pulverized in the interface between the binder resin and the charge control agent, and the charge control agent tends to be exposed to the surface of the toner particle. Consequently, the effect of the charge control agent is considered to be more remarkably exerted.

Examples of the acetic acid ester include: methyl acetate, ethyl acetate, propyl acetate, butyl acetate, pentyl acetate and hexyl acetate. Among these, butyl acetate is preferable, and n-butyl acetate is more preferable.

In the present invention, the content of the acetic acid ester contained in the charge control agent was measured as follows.

The determination of the amount of the organic volatile component of the toner in terms of toluene by the organic volatile component analysis based on the head space method (heating temperature 120° C.) was performed as follows.

In the vial container (volume: 22 mL) for the head space method, 50 mg of the charge control agent was precisely weighed, and the vial container was sealed with a crimp cap and a dedicated septum coated with a fluororesin by using a crimper. The vial container was set in a head space sampler, and gas chromatogram (GC) analysis was performed under the following conditions. The total area value of the peaks in the obtained GC chart was calculated by data processing. In this case, an empty vial container that is sealed with no toner was also measured as the blank, and the measurement value in the blank measurement was subtracted from the measurement data of the toner.

Three vial containers in each of which only toluene was precisely weighed (0.1 μL, 0.5 μL, 1.0 μL) were prepared; before the measurement of the toner measurement sample, each of the three vial containers was measured under the following analysis conditions, and then a calibration curve was depicted on the basis of the placement amounts of toluene and the toluene area values.

The amount of the organic volatile component amount in terms of toluene is obtained as follows: the area value of the organic volatile components is converted into the mass of toluene on the basis of the calibration curve, and then further converted into the value based on the mass of the toner.

(Measurement Apparatus and Measurement Conditions)

Head space sampler: Turbo Matrix HS40 (trade name), manufactured by PerkinElmer Japan Co., Ltd.

Oven temperature: 120° C.

Transfer line temperature: 125° C.

Needle temperature: 125° C.

Hot-keeping time: 60 minutes
Cycle time: 65 minutes
Pressurizing time: 2.5 minutes
Injection time: 0.08 minute
Carrier gas: Helium gas
GC: TRACE GC Ultra (trade name), manufactured by Thermo Fischer Scientific K.K.
MS: ISQ (trade name), manufactured by Thermo Fischer Scientific K.K.
Column: HP-5MS (inner diameter: 0.25 mm, film thickness: 0.25 μm, column length: 60 m)
Temperature increase conditions: (1) 40° C.: holding for 3 minutes, (2) temperature increase to 70° C. at 2° C./min, (3) temperature increase to 150° C. at 5° C./min, (4) temperature increase to 300° C. at 10° C./min, and then holding for 1 minute.
Inlet Conditions
Temperature: 200° C.
Pressure: 150 kPa
Split flow: 10 mL
Split ratio: 7

The electric conductivity of the charge control agent according to the present invention, in the state of being dispersed in a content of 1% by mass in ion-exchanged water is preferably 300 μS/cm or less, more preferably 200 μS/cm or less and furthermore preferably 100 μS/cm or less. The electric conductivity represents the contents of the water-soluble ions and the like contained in the charge control agent; the higher electric conductivity indicates that the substances such as these ions are contained in the larger amounts. By reducing the amounts of the water-soluble ions contained in the charge control agent, the charge control agent and the binder resin are allowed to more effectively interact with each other, consequently the charge amount of the toner can be made higher, and hence the scattering is suppressed and the line reproducibility is improved.

Examples of the method for regulating the electric conductivity of the charge control agent to be 300 μS/cm or less include a method in which the charge control agent is repeatedly washed with a sufficient amount of water, and filtered. Examples of the filtration method include filter press and centrifugal filtration, and also include a method using a reverse osmosis membrane or a semipermeable membrane, and a purification method based on the crystal precipitation operation in which the charge control agent is dissolved and crystals are reprecipitated.

In the present invention, the electric conductivity was measured as follows.

A dispersion was obtained by dispersing 1.5 g of a dried product of the charge control agent in 150 mL of ion-exchanged water. The dispersion was boiled for 15 minutes. The ion-exchanged water was evaporated by boiling, and hence the amount of the dispersion was reduced. After the boiling, the dispersion was cooled to room temperature by flowing water, filtered with a 5A filter paper, and thus a filtrate was obtained. While a filter paper was being washed with ion-exchanged water, the ion-exchanged water was added to the filtrate, and finally ion-exchanged water was directly added to the filtrate to regulate the volume of the filtrate so as to be 150 mL. The electric conductivity of the resulting dispersion was measured with an electric conductivity meter (trade name: HORIBA conductivity meter ES-14) manufactured by Horiba, Ltd.

The specific surface area of the charge control agent according to the present invention is preferably 3.0 $m^2/g$ or more and 30.0 $m^2/g$ or less.

Examples of the method for including the compound represented by the formula [1] in the toner include the following method.

A method in which the compound represented by the formula [1] is added to the binder resin together with a colorant and the like, the resulting mixture is kneaded and pulverized (pulverized toner). The compound represented by the formula [1] is internally added to the toner particle.

A method in which the compound represented by the formula [1] is added to a polymerizable monomer, and the toner is obtained by polymerizing the monomer (polymerized toner). The compound represented by the formula [1] is internally added to the toner particle.

A method in which a toner particle is beforehand produced, and subsequently the compound represented by the formula [1] is added to the surface of the toner particle. The compound represented by the formula [1] is externally added to the toner particle.

The toner of the present invention can be used as a magnetic one-component toner, a nonmagnetic one-component toner, and a toner for two-component development (nonmagnetic toner).

When the toner of the present invention is used as the magnetic one-component toner, examples of the colorant for the toner particle include a magnetic iron oxide particle.

Examples of the magnetic iron oxide particle include:
magnetic iron oxides such as magnetite, maghemite and ferrite, or magnetic iron oxide additionally containing metal oxides different from these;
metals such as Fe, Co and Ni, or alloys of these metals and the metals such as Al, Co, Cu, Pb, Mg, Ni, Sn, Zn, Sb, Be, Bi, Cd, Ca, Mn, Se, Ti, W, and V; and
mixtures of these.

When the toner of the present invention is used as the nonmagnetic one-component toner or the toner for two-component development (nonmagnetic toner), examples of the colorant for the toner particle include the following.

Examples of the black colorant include: carbon black such as furnace black, channel black, acetylene black, thermal black and lamp black.

Examples of the black colorant also include magnetic particles of magnetite and ferrite.

Of the yellow colorants, examples of the pigment as a yellow colorant include:
C.I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, 191,
C.I. Vat Yellow 1, 3, 20.

Of the yellow colorants, examples of the dye as a yellow colorant include:
C.I. Solvent Yellow 19, 44, 77, 79, 81, 82, 93, 98, 103, 104, 112, 162.

Of the cyan colorants, examples of the pigment as a cyan colorant include:
C.I. Pigment Blue 1, 7, 15, 15:1, 15:2, 15:3, 15:4, 16, 17, 60, 62, 66,
C.I. Vat Blue 6,
C.I. Acid Blue 45.

Of the cyan colorants, examples of the dye as a cyan colorant include:
C.I. solvent blue 25, 36, 60, 70, 93, and 95.

Of the magenta colorants, examples of the pigment as a magenta colorant include:
C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, 254, C.I. Pigment Violet 19, C.I. Vat Red 1, 2, 10, 13, 15, 23, 29, 35.

Of the magenta colorants, examples of the dye as a magenta colorant include:

C.I. Solvent Red 1, 3, 8, 23, 24, 25, 27, 30, 49, 52, 58, 63, 81, 82, 83, 84, 100, 109, 111, 121, 122, C.I. Disperse Red 9, C.I. Solvent Violet 8, 13, 14, 21, 27, C.I. Disperse Violet 1, C.I. Basic Red 1, 2, 9, 12, 13, 14, 15, 17, 18, 22, 23, 24, 27, 29, 32, 34, 35, 36, 37, 38, 39, 40, C.I. Basic Violet 1, 3, 7, 10, 14, 15, 21, 25, 26, 27, 28.

The colorants of respective colors may be used each alone or in combinations of two or more thereof.

For the purpose of imparting releasability to the toner, the toner particle preferably includes a releasing agent (wax).

From the viewpoint of the dispersibility in the toner particle and the releasability of the toner, the wax is preferably a hydrocarbon-based wax such as low molecular weight polyethylene, low molecular weight polypropylene, microcrystalline wax or paraffin wax.

The releasing agents may be used each alone or in combinations of two or more thereof.

Examples of the releasing agent include:

oxides of aliphatic hydrocarbon-based waxes such as oxidized polyethylene wax or the block copolymers thereof;

waxes mainly composed of fatty acid esters, such as carnauba wax, sasol wax and montanic acid ester wax;

partially or wholly deoxidized products of fatty acid esters such as deoxidized carnauba wax;

saturated linear chain fatty acids such as palmitic acid, stearic acid and montanic acid;

unsaturated fatty acids such as brassidic acid, eleostearic acid and parinaric acid;

saturated alcohols such as stearyl alcohol, aralkyl alcohol, behenyl alcohol, carnaubyl alcohol, ceryl alcohol and melissyl alcohol;

long chain alkyl alcohols;

polyhydric alcohols such as sorbitol;

fatty acid amides such as linoleic acid amide, oleic acid amide and lauric acid amide;

saturated fatty acid bis amides such as methylene-bis-stearic acid amide, ethylene-bis-capric acid amide, ethylene-bis-lauric acid amide and hexamethylene-bis-stearic acid amide;

unsaturated fatty acid amides such as ethylene-bis-oleic acid amide, hexamethylene-bis-oleic acid amide, N,N'-dioelyladipic acid amide, N,N-dioelylsebacic acid amide; aromatic bis-amides such as m-xylylene-bis stearic acid amide and N,N-distearylisophthalic acid amide;

fatty acid metal salt (generally, referred to as metallic soaps) such as calcium stearate, calcium laurate, zinc stearate and magnesium stearate;

waxes obtained by grafting aliphatic hydrocarbon-based waxes with vinyl-based monomers such as styrene and acrylic acid;

partially esterified compounds of fatty acids and polyhydric alcohols such as behenic monoglyceride; and methyl ester compounds each having a hydroxyl group obtained by the hydrogenation of vegetable fats and oils.

In the present invention, hydrocarbon-based waxes are preferably used, and among these, aliphatic hydrocarbon-based waxes are more preferably used.

Examples of the aliphatic hydrocarbon-based waxes include:

alkylene polymers each having a low molecular weight, obtained by radical polymerizing alkylenes under a high pressure, or obtained by polymerizing alkylenes under a low pressure with a Ziegler catalyst;

alkylene polymers obtained by thermal decomposition of high-molecular weight alkylene polymers;

a synthetic hydrocarbon wax obtained from the distillation residue of the hydrocarbon obtained by the Arge method from a synthesis gas containing carbon monoxide and hydrogen, and a synthetic hydrocarbon wax obtained by hydrogenation of the foregoing synthetic hydrocarbon wax; and waxes obtained by fractionating these aliphatic hydrocarbon-based waxes by taking advantage of press sweating method, solvent method or vacuum distillation, or by fractional crystallization.

Examples of the starting materials of the aliphatic hydrocarbon-based waxes include:

hydrocarbons synthesized by the reaction between carbon monoxide and hydrogen, using metal oxide-based catalysts (mostly two or more component systems, namely multicomponent systems) (for example, hydrocarbon compounds synthesized by the synthol method, or the hydrocoal method (using fluidized catalyst bed));

hydrocarbons having at most several hundreds of carbon atoms obtained by the Arge method (using fixed catalyst bed) allowing wax-like hydrocarbons in large amounts; and hydrocarbons obtained by polymerization of alkylenes such as ethylene with the Ziegler catalysts.

Specific examples of the aliphatic hydrocarbon-based waxes include:

Viscol 330-P, 550-P, 660-P and TS-200 (trade names), manufactured by Sanyo Chemical Industries, Ltd.;

Hi-Wax 400P, 200P, 100P, 410P, 420P, 320P, 220P, 210P and 110P (trade names), manufactured by Mitsui Chemicals, Inc.;

Sazol H1, H2, C80, C105 and C77 (trade names), manufactured by Sazol Ltd.;

HNP-1, HNP-3, HNP-9, HNP-10, HNP-11 and HNP-12 (trade names), manufactured by Nippon Seiro Co., Ltd.;

Unilin 350, 425, 550 and 700, Unicid 350, 425, 550 and 700 (trade names), manufactured by Toyo ADL Corp. (former company name: Toyo Petrolite Co., Ltd.); and Japanese wax, bees wax, rice wax, candelilla wax and carnauba wax (trade names) manufactured by Cerarica NODA Co., Ltd.

When a toner particle is produced by a kneading and pulverizing method, the releasing agent may be added in the kneading step (melt kneading step) or in the production process of the binder resin of the toner particle.

The content of the releasing agent in the toner particle is preferably 1 part by mass or more and 20 parts by mass or less in relation to 100 parts by mass of the binder resin in the toner particle.

In the present invention, for the charge control agent of the toner particle, other charge control agents can be used in combination in addition to the charge control agent according to the present invention. Examples of such other charge control agents include:

azo-based iron compounds, azo-based chromium compounds, azo-based manganese compounds, azo-based cobalt compounds, azo-based zirconium compounds, chromium compounds of carboxylic acid derivatives, zinc compounds of carboxylic acid derivatives, aluminum compounds of carboxylic acid derivatives and zirconium compounds of carboxylic acid derivatives.

As the foregoing carboxylic acid derivatives, aromatic hydroxycarboxylic acids are preferable. As the other charge control agents, charge control resins can also be used.

When the charge control agent according to the present invention and the other charge control agent are used in combination, the content of the other charge control agent is preferably 0.1 part by mass or more and 10 parts by mass or less, in relation to 100 parts by mass of the binder resin in the toner particle.

The toner of the present invention may be mixed with a carrier to be used as a two-component developer.

Examples of the carrier include: carriers such as ferrite and magnetite; resin-coated carriers; and a binder-type carrier prepared by dispersing magnetic particles in a resin.

The resin-coated carrier is a carrier mainly composed of carrier core particles and the resin (coating material) covering (coating) the surface of the carrier core particles.

Examples of the resin used as the coating material include:

styrene-acrylic resins such as styrene-acrylic acid ester copolymer and styrene-methacrylic acid ester copolymer; acrylic resins such as acrylic acid ester copolymer and methacrylic acid ester copolymer;

fluorine-containing resins such as polytetrafluoroethylene, monochlorotrifluoroethylene polymer and polyvinylidene fluoride;

silicone resin;

polyester (polyester resin);

polyamide (polyamide resin);

polyvinyl butyral;

aminoacrylate resin;

ionomer resin; and polyphenylene sulfide (polyphenylene sulfide resin).

The resins as the coating materials may be used each alone or in combinations of two or more thereof.

In the present invention, from the viewpoint of improvement of the charge stability, developability, fluidity and durability of the toner, it is preferable to externally add silica fine particles to the toner particle. The silica fine particles are used preferably in an amount of 0.01 part by mass or more and 8.00 parts by mass or less and more preferably in an amount of 0.10 part by mass or more and 5.00 parts by mass, in relation to 100 parts by mass of the toner particle.

The silica fine particle preferably has a specific surface area (BET specific surface area) of 30 $m^2/g$ or more and 500 $m^2/g$ or less, and more preferably 50 $m^2/g$ or more and 400 $m^2/g$ or less, as measured by the BET method based on nitrogen adsorption. The BET specific surface area of the silica fine particle can be calculated by using, for example, a specific surface area meter, Autosope 1 (trade name) manufactured by Quantachrome Instruments, Inc. (former company name: Yuasa-ionics Co., Ltd.), GEMINI 2360/2375 (trade name), manufactured by Micromeritics Corp., or TriStar 3000 (trade name), manufactured by Micromeritics Corp., and by allowing nitrogen gas to adsorb to the surface of the silica fine particles, and using the BET multipoint method.

The silica fine particles are preferably treated with a treating agent, from the viewpoint of hydrophobization and control of frictional chargeability. Examples of the treating agent for the silica fine particles include: unmodified silicone varnish, various modified silicone varnishes, unmodified silicone oil, various modified silicone oils, silane coupling agents, functional group-containing silane compounds and other organic silicon compounds.

If necessary, other additives may be externally added to the toner of the present invention. Examples of the other external additives include: a charging aid, an electroconductivity imparting agent, a fluidity imparting agent, a caking-preventing agent, a releasing agent at the time of hot roller fixing, a lubricant, and resin fine particles or inorganic fine particles serving as abrading agents and the like.

Examples of the lubricant include: a polyethylene fluoride particle, a zinc stearate particle and a polyvinylidene fluoride particle.

Examples of the abrading agent include a cerium oxide particle, a silicon carbide particle and a strontium titanate particle. Among these, a strontium titanate particle is preferable.

Examples of the method for producing the toner of the present invention include the following method.

At the beginning, a mixture is obtained by mixing the binder resin and the charge control agent, and if necessary, a colorant, a wax and other additives, with a mixer such as a Henschel mixer or a ball mill. Then, a kneaded product (melt-kneaded product) is obtained by melt-kneading the mixture with a heating kneader such as a twin screw kneading extruder, a heating roll, a kneader and an extruder. At the time of melt kneading, a wax, a magnetic iron oxide particle, a metal-containing compound and the like can be added. Next, the kneaded product is cooled and solidified, and then the kneaded product is pulverized by using a pulverizer, and classified by using a classifier to yield a toner. If necessary, a toner can be obtained by mixing the toner particles and an external additive(s) with a mixer such as a Henschel mixer.

Examples of the mixer include:

Henschel Mixer (trade name) manufactured by Nippon Coke & Engineering Co., Ltd. (former company name: Mitsui Mining Co., Ltd.), Supermixer (trade name) manufactured by Kawata MFG Co., Ltd., Ribocorn (trade name) manufactured by Okawara MFG. Co., Ltd., Nauta Mixer (trade name), Tabulizer (trade name) and Cyclomix (trade name) manufactured by Hosokawa Micron Corp., Spiral Pin Mixer (trade name) manufactured by Pacific Machinery & Engineering Co., Ltd., and Loedige Mixer (trade name) manufactured by Matsubo Corp.

Examples of the kneader include:

KRC Kneader (trade name) manufactured by Kurimoto, Ltd.,

Buss Co-kneader (trade name) manufactured by Buss Co., Ltd.,

TEM-type Extruder (trade name) manufactured by Toshiba Machine Co., Ltd.,

TEX Twin Screw Kneader (trade name) manufactured by the Japan Steel Works, Ltd., PCM Kneader (trade name) manufactured by Ikegai Corp. (former company name: Ikegai Iron Works, Ltd.), Three Roll Mill (trade name), Mixing Roll Mill (trade name) and Kneader (trade name) manufactured by Inoue Mfg., Inc., Kneadex (trade name) manufactured by Nippon Coke & Engineering Co., Ltd. (former company name: Mitsui Mining Co., Ltd.), Ms-type Pressure Kneader (trade name) and Kneader Ruder (trade name) manufactured by Nihon Spindle Manufacturing Co., Ltd. (former company name: Moriyama Co., Ltd.), and banbury type mixer manufactured by Kobe Steel, Ltd.

Examples of the pulverizer include:

Counter Jet Mill (trade name), Micron Jet (trade name) and Inomizer (trade name) manufactured by Hosokawa Micron Corp., IDS type Mill (trade name) and PJM Jet Pulverizer (trade name) manufactured by Nippon Pneumatic Mfg. Co., Ltd., Cross Jet Mill (trade name) manufactured by Kurimoto, Ltd., Ulmax (trade name) manufactured by Nisso Engineering Co., Ltd., SK Jet-O-Mill (trade name) manufactured by Seishin Enterprize Co., Ltd., Kryptron (trade name) manufactured by Earthtechnica Co., Ltd. (former company name: Kawasaki Heavy Industries, Ltd.), Turbo Mill (trade name) manufactured by Freund Turbo Corp. (former company name: Turbo Industries Co., Ltd.), and Super Rotor (trade name) manufactured by Nisshin Engineering Inc.

Examples of the classifier include:

Classiel (trade name), Micron Calssifier (trade name) and Spedic Classifier (trade name) manufactured by Seishin Enterprize Co., Ltd., Turbo Classifier (trade name) manufactured by Nisshin Engineering Inc.

Micron Separator (trade name), Turbo Plex (ATP) (trade name) and TSP Separator (trade name) manufactured by Hosokawa Micron Corp., Elbow Jet (trade name) manufactured by Nittesu Mining Co., Ltd., Dispersion Separator (trade name) manufactured by Nippon Pneumatic Mfg. Co., Ltd., and YM Microcut (trade name) manufactured by Uras Techno Co., Ltd. (former company name: Yasukawa Shoji Co., Ltd.).

Examples of the sieving apparatus for sieving coarse particles include:

Ultrasonic (trade name) manufactured by Koei Sangyo Co., Ltd.

Resona Sieve (trade name) and Gyro Shifter (trade name) manufactured by Tokuju Corp., Vibrasonic System (trade name) manufactured by Dalton Co., Ltd., Sonicreen (trade name) manufactured by Sintokogio, Ltd., Turbo Screener (trade name) manufactured by Freund Turbo Corp. (former company name: Turbo Industries Co., Ltd.), Microshifter (trade name) manufactured by Makino Mfg. Co., Ltd., and circular vibrating sieves.

In the present invention, the particle size (particle size distribution) of the toner was measured as follows.

[Measurement of Weight Average Particle Size (D4) of Toner]

The weight average particle size (D4) of the toner was measured by using a precise particle size distribution measurement apparatus (trade name: Coulter Counter Multisizer 3) manufactured by Beckman Coulter, Inc., and an appended dedicated software (trade name: Beckman-Coulter Multisizer 3, Version 3.51). The precise particle size distribution measurement apparatus is equipped with a 100-μm aperture tube, and is a measurement apparatus based on the pore electric resistance method. The effective measurement channel number was set at 25,000, and the analysis of the measured data was performed to calculate the weight average particle size (D4).

As the electrolyte aqueous solution used for the measurement, a solution prepared by dissolving guaranteed grade sodium chloride in ion-exchanged water so as for the concentration of the solution to be 1% by mass can be used. Examples of such an electrolyte aqueous solution include ISOTON II (trade name) manufactured by Beckman-Coulter, Inc.

Before performing the measurement and analysis, the setting of the dedicated software was made as follows.

In the "Screen for Altering Standard Operation Method (SOM)," of the dedicated software, the total count number of the control mode is set at 50,000 particles, the number of measurement runs was set at one, the Kd value was set at a value obtained by using the "10.0-μm standard particles" (manufactured by Beckman-Coulter, Inc.). By pushing the threshold value/noise level measurement button, the threshold value and the noise level were automatically set. The current was set at 1600 μA, the gain was set at 2, the electrolyte solution was set at ISOTON II, and the flush of the aperture tube after measurement was marked.

In the "Screen for Setting Pulse to Particle Size Conversion" of the dedicated software, the bin interval was set at the logarithmic particle size, the particle size bin was set at the 256 particle size bin, and the particle size range was set at a range from 2 μm to 60 μm.

The specific measurement method is as follows.

(1) In a 250-ml round-bottom glass beaker for exclusive use for Multisizer 3, approximately 200 mL of the electrolyte aqueous solution was placed, the beaker was set on a sample stand, and the solution was stirred with a stirrer rod at 24 revolutions/second in an anticlockwise manner. With the function of "flush of aperture" of the analysis software, the dirt and the air bubbles inside the aperture tube were removed.

(2) In a 100-mL flat bottom glass beaker, approximately 30 mL of the electrolyte aqueous solution was placed, and in this beaker, as a dispersant, approximately 0.3 mL of a diluted solution prepared by diluting Contaminon N (trade name) manufactured by Wako Pure Chemical Industries Ltd., by a factor of 3 in terms of mass with ion-exchanged water was added, Contaminon N is a 10% by mass aqueous solution of a neutral detergent having a pH of 7, for use in washing precision measurement devices, composed of a nonionic surfactant, an anionic surfactant and an organic builder.

(3) A predetermined amount of ion-exchanged water was placed in the water tank of a supersonic dispersion device (trade name: Ultrasonic Dispension System Tetora 150) manufactured by Nikkaki Bios Co., Ltd., and 2 mL of Contaminon N was added in the water tank. The Ultrasonic Dispension System Tetora 150 is equipped with two built-in oscillators of an oscillation frequency of 50 kHz with a phase shift of 180° therebetween, and has an electric output power of 120 W.

(4) The beaker of (2) was set in the beaker fixing hole of the ultrasonic dispersion device, and then the ultrasonic dispersion device was made to operate. Then, the height of the beaker was adjusted in such a way that the resonance state of the liquid surface of the electrolyte aqueous solution in the beaker came to be maximum.

(5) Under the condition that the electrolyte aqueous solution in the beaker of (4) was being irradiated with ultrasonic wave, 10 mg of the toner was added to and dispersed in the electrolyte aqueous solution, in a small amount at a time. Then, the solution continued to be subjected to an ultrasonic dispersion treatment further for 60 seconds. In performing the ultrasonic dispersion, the water temperature of the water tank was appropriately regulated to be 10° C. or higher and 40° C. or lower.

(6) Into the round-bottom beaker described in (1) placed in the sample stand, the electrolytic aqueous solution of (5) in which a toner was dispersed was dropwise added by using a pipette, and the measurement concentration was adjusted to be 5%. Then, the measurement was performed until the number of the measured particles reached 50000.

(7) The measurement data were analyzed with the dedicated software attached to the apparatus to calculate the weight average particle size (D4). When the graph/% by volume is set in the dedicated software, an "average diameter" of the analysis/volume statistical value (arithmetic average) in the screen is the weight average particle size (D4).

EXAMPLES

Hereinafter, the present invention is described specifically with reference to Examples.

Production Example of Binder Resin A-1

Bisphenol A-ethylene oxide (2.2 mole adduct): 45.0 parts by mole

Bisphenol A-propylene oxide (2.2 mole adduct): 40.0 parts by mole

Ethylene glycol: 15.0 parts by mole

Terephthalic acid: 100.0 parts by mole 95 parts by mass of a mixture of the monomers for constituting the polyester unit and 5 parts by mass of an aliphatic monoalcohol having 50 carbon atoms (a wax having a hydroxy group at one terminal of polyethylene) were placed together in a 5-L autoclave with 500 ppm of titanium tetrabutoxide. A reflux condenser, a water separator, a nitrogen gas introduction tube, a thermometer and a stirrer were attached to the autoclave, and while nitrogen gas was being introduced into the autoclave, the polycondensation reaction was performed at 230° C. The reaction time was regulated so as for the softening point of the obtained resin to be a predetermined value. After the completion of the reaction, the reaction product was taken out from the vessel, cooled, and pulverized to yield the binder resin A-1.

Production Examples of Binder Resins A-2 to A-8

Each of the binder resins A-2 to A-8 was obtained in the same manner as in the production example of the binder resin A-1 except that in the production example of the binder resin A-1, the parts by mole of ethylene glycol (hereinafter, also denoted by "EG"), the parts by mole of bisphenol A-ethylene oxide (2.2 mole adduct) (hereinafter, also denoted as "BPA-EO"), the parts by mass of the aliphatic compound and the number of the carbon atoms of the aliphatic compound were altered as shown in Table 2.

TABLE 2

| Resin No. | BPA-EO (parts by mole) | EG (parts by mole) | Aliphatic compound (parts by mass) | Aliphatic compound (number of carbon atoms) | Tg (° C.) | Tm (° C.) |
|---|---|---|---|---|---|---|
| A-1 | 45 | 15 | 5 | 50 | 55 | 95 |
| A-2 | 45 | 15 | 7 | 50 | 50 | 95 |
| A-3 | 45 | 15 | 2 | 50 | 57 | 95 |
| A-4 | 40 | 20 | 1 | 50 | 49 | 98 |
| A-5 | 55 | 5 | 1 | 50 | 51 | 98 |
| A-6 | 59 | 1 | 1 | 80 | 52 | 98 |
| A-7 | 30 | 30 | 1 | 80 | 50 | 97 |
| A-8 | 25 | 35 | 10 | 40 | 50 | 99 |

Production Example of Binder Resin A-9

Bisphenol A-ethylene oxide (2.2 mole adduct): 25.0 parts by mole

Bisphenol A-propylene oxide (2.2 mole adduct): 40.0 parts by mole

Ethylene glycol: 35.0 parts by mole

Terephthalic acid: 80.0 parts by mole

Trimellitic anhydride: 20.0 parts by mole 88 parts by mass of the mixture of the monomers for constituting the polyester unit and 12 parts by mass of an aliphatic monoalcohol having 40 carbon atoms (a wax having a hydroxy group at one terminal of polyethylene) were placed together in a 5-L autoclave with 0.2 part by mass of dibutyltin oxide. A reflux condenser, a water separator, a nitrogen gas introduction tube, a thermometer and a stirrer were attached to the autoclave, and while nitrogen gas was being introduced into the autoclave, the polycondensation reaction was performed at 230° C. The reaction time was regulated so as for the softening point of the obtained resin to be a predetermined value. After the completion of the reaction, the reaction product was taken out from the vessel, cooled, and pulverized to yield the binder resin A-9. Tg and Tm of the binder resin A-9 were found to be 60° C. and 135° C., respectively.

Production Example of Binder Resin B-1

(Prescription of Polyester Unit)

Bisphenol A-ethylene oxide (2.2 mole adduct): 100.0 parts by mole

Terephthalic acid: 65.0 parts by mole

Trimellitic anhydride: 25.0 parts by mole

Acrylic acid: 10.0 parts by mole 60 parts by mass of the mixture of the monomers for constituting the polyester unit and 5 parts by mass of the aliphatic monoalcohol having 50 carbon atoms were placed in a four-necked flask. A pressure reducing apparatus, a water separator, a nitrogen gas introduction apparatus, a temperature measurement apparatus and a stirrer were attached to the four-necked flask, and the resulting mixture was stirred at 160° C. in a nitrogen atmosphere.

40 parts by mass of the vinyl-based monomers (styrene: 90.0 parts by mole, 2-ethylhexyl acrylate: 10.0 parts by mole) for constituting the vinyl-based polymer unit and 1 part by mass of benzoyl peroxide as the polymerization initiator were dropwise added into the four-necked flask from a dropping funnel over 4 hours. Then, the reaction was performed at 160° C. for 5 hours.

Subsequently, the temperature was increased to 230° C., 0.2 part by mass of titanium tetrabutoxide was added into the four-necked flask to the total amount of the monomers for constituting the polyester unit, and the polymerization reaction was performed until the softening point of the obtained resin came to be the predetermined value. After the completion of the reaction, the reaction product was taken out from the vessel, cooled, and pulverized to yield the binder resin B-1.

Production Examples of Binder Resins B-2 to B-6

In the production example of the binder resin B-1, the parts by mass and the number of the carbon atoms of the aliphatic compound were altered as shown in Table 3 in each of the production examples of the binder resins B-2 to B-6. Otherwise, in the same manner as in the production example of the binder resin B-1, the binder resins B-2 to B-6 were obtained.

TABLE 3

| Resin No. | Aliphatic compound (parts by mass) | Aliphatic compound (number of carbon atoms) | Tg (° C.) | Tm (° C.) |
|---|---|---|---|---|
| B-1 | 5 | 50 | 65 | 135 |
| B-2 | 7 | 50 | 62 | 140 |
| B-3 | 2 | 50 | 64 | 130 |
| B-4 | 1 | 50 | 58 | 142 |
| B-5 | 1 | 80 | 58 | 142 |
| B-6 | 10 | 40 | 56 | 135 |

Production Examples of Binder Resins B-7 to B-12

In the production example of the binder resin B-1, 0.2 part by mass of titanium tetrabutoxide was altered to 0.2 part by mass of dibutyltin oxide, and the parts by mass, the number of the carbon atoms and the type of the aliphatic compound were altered as shown in Table 4 in each of the production examples of the binder resins B-7 to B-12. Otherwise, in the same manner as in the production example of the binder resin B-1, the binder resins B-7 to B-12 were obtained.

TABLE 4

| Resin No. | Aliphatic compound (parts by mass) | Aliphatic compound (number of carbon atoms) | Aliphatic compound (type) | Tg (° C.) | Tm (° C.) |
|---|---|---|---|---|---|
| B-7 | 12 | 30 | Alcohol | 55 | 135 |
| B-8 | 12 | 102 | Alcohol | 58 | 138 |
| B-9 | 12 | 102 | Carboxylic acid | 58 | 138 |
| B-10 | 12 | 110 | Carboxylic acid | 60 | 135 |
| B-11 | 12 | 16 | Carboxylic acid | 55 | 135 |
| B-12 | 0 | 0 | — | 68 | 132 |

Charge Control Agent Production Example 1

57.4 parts by mass of 4-chloro-2-aminophenol was added to a mixed solution composed of 580 parts by mass of water and 84 parts by mass of 35% hydrochloric acid, and stirred under cooling to yield a hydrochloric acid solution. Subsequently, the hydrochloric acid aqueous solution was ice cooled to maintain the temperature of the hydrochloric acid aqueous solution within a range of 0° C. or higher and 5° C. or lower. Next, 28.2 parts by mass of sodium nitrite dissolved in 50.7 parts by mass of water was dropwise added to the hydrochloric acid aqueous solution, and stirred for 2 hours to perform diazotization. Sulfamic acid was added to the reaction solution to cause excessive nitrous acid to disappear, and then the reaction solution was filtered to yield a diazo solution.

Next, 101 parts by mass of 3-methyl-1-(3,4-dichlorophenyl)-5-pyrazolone was added to and dissolved in the mixed solution composed of 475 parts by mass of water, 95 parts by mass of sodium carbonate and 840 parts by mass of n-butanol. The diazo solution was added to the resulting solution, and stirred for 4 hours while the temperature of the solution within a range of 20° C. or higher and 22° C. or lower, to perform the coupling reaction. Subsequently, 43.5 parts by mass of a 25% sodium hydroxide aqueous solution was added to the solution and stirred for cleaning, and then the aqueous layer as the lower layer was removed to yield a reaction solution.

Next, 226 parts by mass of water, 29 parts by mass of salicylic acid, 823.7 parts by mass of n-butanol and 242.4 parts by mass of a 15% sodium carbonate aqueous solution were added to the reaction solution, and the reaction solution is stirred. 89.6 parts by mass of a 38% ferric chloride aqueous solution was added to the reaction solution, the solution temperature was increased to 30° C., then the reaction solution was stirred for 8 hours to perform the complexation reaction, and the reaction product was filtered out to yield a filtered product. The operation of washing the filtered product with 1000 parts by mass of water was repeated five times. Next, the filtered product was dried (vacuum dried) at 60° C. for 24 hours to yield a 98.8 parts by mass of a mono azo metal compound. This is referred to as the charge control agent 1.

The structure of the charge control agent 1 was identified on the basis of the infrared absorption spectrum, the visible absorption spectrum, the elemental analysis (C, H, N), the atomic absorption spectrometry and the mass spectrum, and consequently, it was verified that the compound represented by the formula (3) ($X^+$ in the formula (3) was a hydrogen ion ($H^+$)) was contained.

The particle size distribution of the charge control agent 1 was measured, and the volume average particle size was found to be 5.5 μm, and the volume-based proportion of the particles having the particle sizes of 4.0 μm or more was found to be 73% by volume. The electric conductivity of the dispersion prepared by dispersing the charge control agent 1 in ion-exchanged water in a content of 1% by mass was found to be 560 μS/cm.

Charge Control Agent Production Example 2

80 parts by mass of the charge control agent 1 obtained in the charge control agent production example 1 was added to 320 parts by mass of dimethyl sulfoxide, and dissolved. A mixed solution composed of 5 parts by mass of a defoaming agent (trade name: KF995, cyclic dimethyl silicone) manufactured by Shin-Etsu Chemical Co., Ltd., 0.005 part by mass of n-butyl acetate and 5000 parts by mass of water was dropwise added to the resulting solution, to precipitate a monoazo metal compound. After the completion of the dropwise addition, the obtained precipitate was washed with 1000 parts by mass of water, and then the precipitate was dried (vacuum dried) at 60° C. for 24 hours to yield the charge control agent 2.

The structure of the charge control agent 2 was identified on the basis of the infrared absorption spectrum, the visible absorption spectrum, the elemental analysis (C, H, N), the atomic absorption spectrometry and the mass spectrum, and consequently, it was verified that the compound represented by the formula (3) ($X^+$ in the formula (3) was a hydrogen ion ($H^+$)) was contained.

The particle size distribution of the charge control agent 2 was measured, and the volume average particle size was found to be 0.9 μm, and the volume-based proportion of the particles having the particle sizes of 4.0 μm or more was found to be 6% by volume. The content of n-butyl acetate in the charge control agent 2 was 9 ppm. The electric conductivity of the dispersion prepared by dispersing the charge control agent 2 in ion-exchanged water in a content of 1% by mass was found to be 21 μS/cm.

Charge Control Agent Production Example 3

In the charge control agent production example 2, 0.005 part by mass of n-butyl acetate was altered to 0.001 part by mass of n-butyl acetate, and the precipitation speed was regulated by the dropwise addition rate. Otherwise in the same manner as in the charge control agent production example 2, the charge control agent 3 was obtained.

The structure of the charge control agent 3 was identified on the basis of the infrared absorption spectrum, the visible absorption spectrum, the elemental analysis (C, H, N), the atomic absorption spectrometry and the mass spectrum, and consequently, it was verified that the compound represented by the formula (3) ($X^+$ in the formula (3) was a hydrogen ion ($H^+$)) was contained.

The particle size distribution of the charge control agent 3 was measured, and the volume average particle size was found to be 1.8 μm, and the volume-based proportion of the particles having the particle sizes of 4.0 μm or more was found to be 12% by volume. The content of n-butyl acetate in the charge control agent 3 was 2 ppm. The electric conductivity of the dispersion prepared by dispersing the charge control agent 3 in ion-exchanged water in a content of 1% by mass was found to be 17 μS/cm.

Charge Control Agent Production Example 4

In the charge control agent production example 2, 0.005 part by mass of n-butyl acetate was altered to 0.3 part by mass of n-butyl acetate, and the precipitation speed was regulated by the dropwise addition rate. Otherwise in the same manner as in the charge control agent production example 2, the charge control agent 4 was obtained.

The structure of the charge control agent 4 was identified on the basis of the infrared absorption spectrum, the visible absorption spectrum, the elemental analysis (C, H, N), the atomic absorption spectrometry and the mass spectrum, and consequently, it was verified that the compound represented by the formula (3) ($X^+$ in the formula (3) was a hydrogen ion ($H^+$)) was contained.

The particle size distribution of the charge control agent 4 was measured, and the volume average particle size was found to be 0.5 μm, and the volume-based proportion of the particles having the particle sizes of 4.0 μm or more was found to be 2% by volume. The content of n-butyl acetate in the charge control agent 4 was 550 ppm. The electric conductivity of the dispersion prepared by dispersing the charge control agent 4 in ion-exchanged water in a content of 1% by mass was found to be 33 μS/cm.

Charge Control Agent Production Example 5

In the charge control agent production example 2, 0.005 part by mass of n-butyl acetate was altered to 0.0001 part by mass of n-butyl acetate, and the precipitation speed was regulated by the dropwise addition rate. Otherwise in the same manner as in the charge control agent production example 2, the charge control agent 5 was obtained.

The structure of the charge control agent 5 was identified on the basis of the infrared absorption spectrum, the visible absorption spectrum, the elemental analysis (C, H, N), the atomic absorption spectrometry and the mass spectrum, and consequently, it was verified that the compound represented by the formula (3) ($X^+$ in the formula (3) was a hydrogen ion ($H^+$)) was contained.

The particle size distribution of the charge control agent 5 was measured, and the volume average particle size was found to be 2.0 μm, and the volume-based proportion of the particles having the particle sizes of 4.0 μm or more was found to be 13% by volume. The content of n-butyl acetate in the charge control agent 5 was 0.1 ppm. The electric conductivity of the dispersion prepared by dispersing the charge control agent 5 in ion-exchanged water in a content of 1% by mass was found to be 14 μS/cm.

Charge Control Agent Production Example 6

In the charge control agent production example 5, 0.0001 part by mass of n-butyl acetate was altered to 0.1 part by mass of n-butyl acetate, 5000 parts by mass of water was altered to 500 parts by mass of water, and the precipitation speed was regulated by the dropwise addition rate. Otherwise in the same manner as in the charge control agent production example 5, the charge control agent 6 was obtained.

The structure of the charge control agent 6 was identified on the basis of the infrared absorption spectrum, the visible absorption spectrum, the elemental analysis (C, H, N), the atomic absorption spectrometry and the mass spectrum, and consequently, it was verified that the compound represented by the formula (3) ($X^+$ in the formula (3) was a hydrogen ion ($H^+$)) was contained.

The particle size distribution of the charge control agent 6 was measured, and the volume average particle size was found to be 2.2 μm, and the volume-based proportion of the particles having the particle sizes of 4.0 μm or more was found to be 16% by volume. The content of n-butyl acetate in the charge control agent 6 was 1000 ppm. The electric conductivity of the dispersion prepared by dispersing the charge control agent 6 in ion-exchanged water in a content of 1% by mass was found to be 293 μS/cm.

Charge Control Agent Production Example 7

In the charge control agent production example 5, 0.0001 part by mass of n-butyl acetate was altered to 0.1 part by mass of n-butyl acetate, 5000 parts by mass of water was altered to 200 parts by mass of water, and the precipitation speed was regulated by the dropwise addition rate. Otherwise in the same manner as in the charge control agent production example 5, the charge control agent 7 was obtained.

The structure of the charge control agent 7 was identified on the basis of the infrared absorption spectrum, the visible absorption spectrum, the elemental analysis (C, H, N), the atomic absorption spectrometry and the mass spectrum, and consequently, it was verified that the compound represented by the formula (3) ($X^+$ in the formula (3) was a hydrogen ion ($H^+$)) was contained.

The particle size distribution of the charge control agent 7 was measured, and the volume average particle size was found to be 2.3 μm, and the volume-based proportion of the particles having the particle sizes of 4.0 μm or more was found to be 18% by volume. The content of n-butyl acetate in the charge control agent 7 was 1100 ppm. The electric conductivity of the dispersion prepared by dispersing the charge control agent 7 in ion-exchanged water in a content of 1% by mass was found to be 365 μS/cm.

Example 1

Production Example of Toner No. 1

Binder resin A-1: 30 parts by mass
Binder resin B-1: 70 parts by mass
Fischer-Tropsch wax (C105 (trade name), melting point: 105° C., manufactured by Sazol Ltd.): 2 parts by mass
Carbon black: 5 parts by mass
Charge control agent 2: 2 parts by mass The above-listed materials were preliminarily mixed with a Henschel mixer, and then melt-kneaded with a twin screw kneading extruder. In this case, the residence time in the twin screw kneading extruder was regulated in such a way that the temperature of the kneaded resin was 150° C. The resulting kneaded product was cooled, and coarsely pulverized with a hammer mill, and then pulverized with a turbo mill. The obtained finely pulverized particles were classified by using a multi-division classifier (trade name: Elbow Jet Classifier, manufactured by Nittesu Mining Co., Ltd.) taking advantage of the Coanda effect, and a toner particle having a weight average particle size (D4) of 7.3 μm was obtained. In relation to 100 parts by mass of the obtained toner particle, 1.0 part by mass of a hydrophobic silica fine particle (BET specific surface area: 140 $m^2/g$, a hexamethyldisilazane treatment was applied as a hydrophobization treatment) and 3.0 parts by mass of a strontium titanate particle (volume average particle size: 1.6 μm) were mixed, and the resulting mixture was externally added to the toner particle. The toner was screened with a sieve having a mesh opening size of 150 μm to yield the toner No. 1.

Next, 8 parts by mass of the toner No. 1 was added to 92 parts by mass of a magnetic carrier, and mixed for 2 minutes by using a turbula mixer to prepare a two-component developer.

On the other hand, 90 parts by mass of the toner No. 1 was added to 10 parts by mass of the magnetic carrier, and mixed for 5 minutes by using a V-type mixer in an environment of normal temperature and normal humidity (23° C., 50% RH) to yield a refill developer (refill two-component developer).

As the magnetic carrier, the carrier for use in the full color copying machine imageRUNNER ADVANCE C7065 manufactured by Canon Inc. was used.

[Evaluations]

The following evaluations were performed for the toner No. 1. The evaluation results are shown in Table 6.

As the paper for evaluation, A4 size plain paper (trade name: CS-814) having a basis weight of 81.4 $g/m^2$, manufactured by Canon Marketing Japan Inc. was used.

As the image forming apparatus for evaluation, a remodeled apparatus of a full color copying machine (trade name: imageRUNNER ADVANCE C7065) manufactured by Canon Inc. was used. Specifically, the full color copying machine was remodeled in such a way that the development contrast was able to be varied (of the voltage applied to the developing sleeve of the developing device, the direct current voltage $V_{DC}$ was able to be varied), and was remodeled in such a way that the toner unfixed image before passing through the fixing device was able to be output.

The developer was placed in the developing device for black of the image forming apparatus for evaluation.

The output images in the following 100,000 sheet endurance test were designed to be images having a printing rate of 5%.

In the evaluation of the low-temperature fixability, the image forming apparatus for evaluation was used, and then an external fixing device (a belt & roller fixing device) detached from a multifunction production machine (trade name: imagePRESS C1+) manufactured by Canon Inc. was used.

[Low-Temperature Fixability]

In the image forming apparatus for evaluation, the direct current voltage $V_{DC}$ was regulated in such a way that the laid-on amount of the toner on the paper was 0.5 $mg/cm^2$ in the case where an FFh image (solid black image) was formed, and then the unfixed FFh image was output.

Subsequently, the fixing temperature in the external fixing device was regulated at intervals of 10° C. within a range from 100° C. to 200° C., and the unfixed FFh image was fixed at the respective temperatures to yield fixed images. In this case, the external fixing device was operated at a process speed of 300 mm/sec. Each of the obtained fixed images was slidingly rubbed five times back and forth with a lens cleaning wiper (trade name: Dusper, manufactured by Ozu Corp.) to which a 4.9 kPa of load was applied, the temperature at which the image density decrease rate between before and after the sliding rubbing was 10% or less was taken as the fixing temperature, and the evaluation was performed according to the following evaluation standards.

A: The fixing temperature is lower than 120° C.
B: The fixing temperature is 120° C. or higher and lower than 130° C.
C: The fixing temperature is 130° C. or higher and lower than 140° C.
D: The fixing temperature is 140° C. or higher and lower than 150° C.
E: The fixing temperature is 150° C. or higher.

The FFh image, and the below-described 00h image and the below-described 30h image are the images in which 256 gradations are represented in terms of the hexadecimal notation (0 to 255 in terms of the decimal notation are 00 to FF in terms of the hexadecimal notation, respectively). The "h" in FFh, 00h and 30h is the initial character of "hexadecimal" (number system with a radix of 16), and explicitly shows that these denotations are represented in the hexadecimal notation. The 00h image means a white ground area (a solid white image, the first gradation in the 256 gradations), and the FFh image means a solid area (a solid black image, the 256th gradation in the 256 gradations). The 30h image is a kind of halftone image.

[Scattering]

By using the image forming apparatus for evaluation, a 100,000 sheet endurance test was performed in a high-temperature high-humidity environment (30° C./80% RH). At the initial stage (before the 100,000 sheet endurance test) and after the 100,000 sheet endurance test, a grid pattern (with a spacing of 1 cm) formed of the lines having a width of 100 μm (width in electrostatic latent image) was output, and the scattering of the toner was visually observed and evaluated by using an optical microscope.

(Evaluation Standards)

A: Lines are extremely sharp and the scattering of the toner is little found.
B: Slight scattering of the toner is found and the lines are sharp.
C: Scattering of the toner is slightly higher in degree, and the lines are sharper as compared with D.
D: Scattering of the toner is high in degree, and the lines are somewhat blurred.
E: Scattering of the toner is extremely high in degree, and does not meet the level of D.

[Line/Solid Ratio]

After performing the 100,000 sheet endurance test in a high-temperature high-humidity environment (30° C./80% RH), the direct current voltage $V_{DC}$ was regulated in such a way that the laid-on amount of the toner on the paper for the FFh image was 0.5 mg/cm$^2$.

Next, in the state in which a solid area (solid black patch) of 1 cm in length×7 cm in width was formed on the photosensitive drum, the image forming apparatus for evaluation was stopped, and the laid-on amount (Mb) of the toner in the solid area on the surface of the photosensitive drum was measured.

Next, in a state in which a stripe area (a patch with line:solid white area=4:8) having 20 lines of 170 μm in width formed in an area of 1 cm in length×7 cm in width was formed on the surface of the photosensitive drum, the image forming apparatus for evaluation was stopped, and the laid-on amount (M1) of the toner on the lines in the stripe area on the surface of the photosensitive drum was measured.

Herein, the lengthwise direction is the circumferential direction of the photosensitive drum, and the widthwise direction is the axial direction of the photosensitive drum.

The laid-on amount of the toner on the lines (Ml/(7×4/12))/ the laid-on amount of the toner on the solid area (Mb/7) was calculated, and the evaluation was performed on the basis of the resulting value. The smaller the value, the more excellent is the toner.

(Evaluation Standards)

A: Less than 1.3

B: 1.3 or more and less than 1.4

C: 1.4 or more and less than 1.5

D: 1.5 or more

[Roughness]

After the 100,000 sheet endurance test as performed in a normal temperature, low humidity environment (23° C./5% RH), a halftone image (30h image) was output, the output image was visually observed, and the roughness of the image was evaluated on the basis of the following standards.

(Evaluation Standards)

A: No roughness is felt, and the image is smooth.

B: Roughness is not quite felt.

C: Roughness is slightly felt.

D: Roughness is definitely felt.

[Selective Developability]

The 100,000 sheet endurance test was performed in a high-temperature high-humidity environment (30° C./80% RH). At the initial stage (before the 100,000 sheet endurance test) and after the 100,000 sheet endurance test, the particle size distribution of the toner in the developing device (developing unit) was measured, and the variation of the weight average particle size of the toner was evaluated on the basis of the following standards. The smaller the variation of the weight average particle size, the more excellent is the toner.

Variation of weight average particle size of toner=weight average particle size (μm) of toner after 100,000 sheet endurance test−weight average particle size (μm) of toner at initial stage (Evaluation Standards)

A: Less than 0.2 μm

B: 0.2 μm or more and less than 0.3 μm

C: 0.3 μm or more and less than 0.4 μm

D: 0.4 μm or more

Examples 2 to 13

Production Examples of Toners No. 2 to No. 13

The toners No. 2 to No. 13 were produced in the same manner as in Example 1 except that the prescription of the toner in Example 1 was altered as shown in Table 5. Then, the toners No. 2 to 13 were evaluated in the same manner as in Example 1. The evaluation results are shown in Table 6.

TABLE 5

| | Toner No. | Binder resin A | parts by mass | Binder resin B | parts by mass | Charge control agent |
|---|---|---|---|---|---|---|
| Example 1 | 1 | A-1 | 30 | B-1 | 70 | Charge control agent 2 |
| Example 2 | 2 | A-1 | 30 | B-1 | 70 | Charge control agent 3 |
| Example 3 | 3 | A-2 | 30 | B-2 | 70 | Charge control agent 4 |
| Example 4 | 4 | A-3 | 30 | B-3 | 70 | Charge control agent 4 |
| Example 5 | 5 | A-4 | 30 | B-4 | 70 | Charge control agent 5 |
| Example 6 | 6 | A-5 | 30 | B-4 | 70 | Charge control agent 6 |
| Example 7 | 7 | A-6 | 30 | B-5 | 70 | Charge control agent 7 |
| Example 8 | 8 | A-7 | 30 | B-5 | 70 | Charge control agent 7 |
| Example 9 | 9 | A-8 | 30 | B-6 | 70 | Charge control agent 7 |
| Example 10 | 10 | A-9 | 100 | — | — | Charge control agent 7 |
| Example 11 | 11 | — | — | B-7 | 100 | Charge control agent 7 |
| Example 12 | 12 | — | — | B-8 | 100 | Charge control agent 7 |
| Example 13 | 13 | — | — | B-9 | 100 | Charge control agent 7 |

TABLE 6

| | Low-temperature fixability | Scat-tering | Line/solid ratio | Rough-ness | Selective developability |
|---|---|---|---|---|---|
| Example 1 | A | A | A | A | A |
| Example 2 | A | A | A | A | A |
| Example 3 | A | A | A | A | A |
| Example 4 | A | A | A | A | A |
| Example 5 | B | A | A | A | B |
| Example 6 | B | A | A | A | B |
| Example 7 | B | A | A | B | C |
| Example 8 | B | A | A | B | C |
| Example 9 | B | A | A | C | C |
| Example 10 | B | A | B | C | C |
| Example 11 | C | B | B | C | C |
| Example 12 | C | B | B | C | C |
| Example 13 | C | C | B | C | C |

Comparative Examples 1 to 5

The toners No. 14 to No. 18 were produced in the same manner as in Example 1 except that the prescription of the toner in Example 1 was altered as shown in Table 7. Then, the toners No. 14 to 18 were evaluated in the same manner as in Example 1. The evaluation results are shown in Table 8. The charge control agent T77 is the compound represented by the following formula [4] (a monoazo iron complex, manufactured by Hodogaya Chemical Co., Ltd.).

Formula [4]

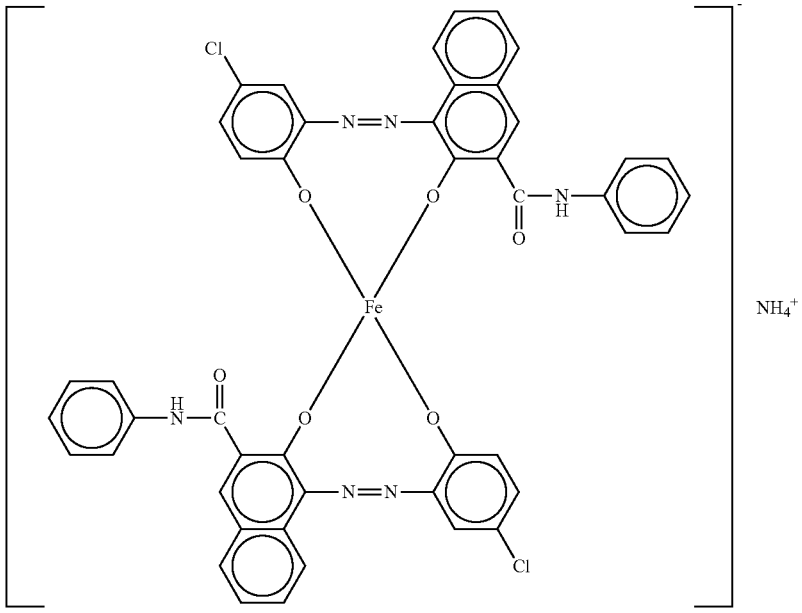

In Comparative Example 1, the evaluation result of the line/solid ratio was C, and the evaluation result of the selective developability was D. This is probably because the use of T77 as the charge control agent instead of the compound represented by the formula [1] degraded the charge uniformity.

In Comparative Examples 2 and 3, the evaluation result of the low-temperature fixability was D. This is probably because the number of the carbon atoms of the aliphatic compound was 110 or 16, and hence the plastic effect on the binder resin was not able to be effectively obtained. The evaluation of the scattering was also D. This also probably because the interaction with the charge control agent was not effectively developed due to the effect of the number of the carbon atoms in the aliphatic compound, and the scattering was affected.

In Comparative Example 4, the evaluation results of the line/solid ratio and the roughness were D. This is probably because, in Comparative Example 3, the charge uniformity was degraded by the use of T77 as the charge control agent instead of the compound represented by the formula [1].

In Comparative Example 5, the evaluation results of the low-temperature fixability and the scattering were E. This is probably because the aliphatic compound was not used, and hence the charge control agent was microscopically segregated at the terminals of the binder resin to degrade the charge uniformity.

TABLE 7

| | Toner No. | Binder resin A | parts by mass | Binder resin B | parts by mass | Charge control agent |
|---|---|---|---|---|---|---|
| Comparative Example 1 | 14 | — | — | B-9 | 100 | T77 |
| Comparative Example 2 | 15 | — | — | B-10 | 100 | Charge control agent 1 |
| Comparative Example 3 | 16 | — | — | B-11 | 100 | Charge control agent 1 |

TABLE 7-continued

| | Toner No. | Binder resin A | parts by mass | Binder resin B | parts by mass | Charge control agent |
|---|---|---|---|---|---|---|
| Comparative Example 4 | 17 | — | — | B-11 | 100 | T77 |
| Comparative Example 5 | 18 | — | — | B-12 | 100 | T77 |

TABLE 8

| | Low-temperature fixability | Scattering | Line/solid ratio | Roughness | Selective developability |
|---|---|---|---|---|---|
| Comparative Example 1 | C | C | C | C | D |
| Comparative Example 2 | D | D | C | C | D |
| Comparative Example 3 | D | D | C | C | D |
| Comparative Example 4 | D | D | D | D | D |
| Comparative Example 5 | E | E | D | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-058172, filed Mar. 20, 2014 and Japanese Patent Application No. 2015-048301, filed Mar. 11, 2015 which are hereby incorporated by reference herein in their entirety.

What is claimed is:

1. A toner comprising a toner particle comprising:

a binder resin comprising a resin having a polyester unit having a capped carboxy group as a terminal group, the capped carboxyl group being a carboxy group capped with an aliphatic monoalcohol having 50-80 carbon atoms; and a charge control agent comprising the compound represented by Formula [1]:

Formula [1]

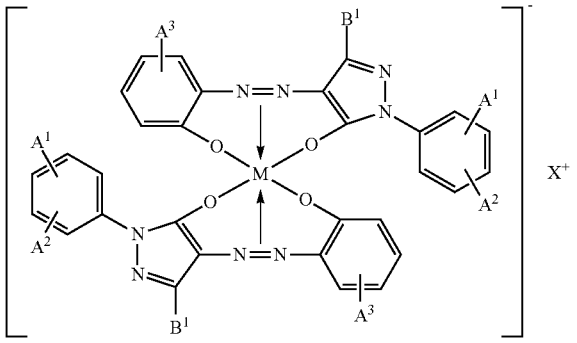

wherein $A^1$, $A^2$ and $A^3$ each independently represent a hydrogen atom, a nitro group, or a halogen atom; $B^1$ represents a hydrogen atom or alkyl group; M represents an iron atom, a chromium atom or an aluminum atom; and $X^+$ represents a hydrogen ion, an alkali metal ion, an ammonium ion or an alkylammonium ion, or mixed ions of two or more of these ions.

2. The toner according to claim 1, wherein the polyester unit is a unit obtained by the polycondensation in the presence of a titanium-based catalyst.

3. The toner according to claim 1, wherein the polyester unit is a unit obtained by the polycondensation between an alcohol component including an aliphatic polyhydric alcohol in a content of 1-30 mol %, and a carboxylic acid component.

4. The toner according to claim 3, wherein the alcohol component includes the aliphatic polyhydric alcohol in a content of 5-30 mol %.

5. The toner according to claim 1, wherein the polyester unit in the resin having the polyester unit is 60% by mass or more in relation to the binder resin.

6. The toner according to claim 1, wherein M in the formula [1] is an iron atom.

7. The toner according to claim 1, wherein $A^1$, $A^2$ and $A^3$ in the formula [1] are each a halogen atom and $B^1$ is an alkyl group.

8. A two-component developer comprising the toner according to claim 1, and a carrier.

* * * * *